US007481508B2

(12) United States Patent
Usui

(10) Patent No.: US 7,481,508 B2
(45) Date of Patent: Jan. 27, 2009

(54) PRINTING APPARATUS AND PRINTING SYSTEM

(75) Inventor: Toshiki Usui, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 392 days.

(21) Appl. No.: 11/206,769

(22) Filed: Aug. 19, 2005

(65) Prior Publication Data

US 2006/0038840 A1 Feb. 23, 2006

(30) Foreign Application Priority Data

Aug. 19, 2004 (JP) ..... 2004-239411

(51) Int. Cl.
*B41J 29/38* (2006.01)

(52) U.S. Cl. ..... 347/11; 347/57

(58) Field of Classification Search ..... 347/11, 347/57, 9, 14, 19, 64

See application file for complete search history.

(56) References Cited

U.S. PATENT DOCUMENTS 6,070,959 A * 6/2000 Kanbayashi et al. ..... 347/11
6,652,057 B2 * 11/2003 Masuda et al. ..... 347/14

FOREIGN PATENT DOCUMENTS

EP 1 319 511 A1 6/2003
JP 2000-52570 A 2/2000
JP 2003-246086 A 9/2003

OTHER PUBLICATIONS

European Search Report.

* cited by examiner

*Primary Examiner*—Thinh H Nguyen
(74) *Attorney, Agent, or Firm*—Sughrue Mion, PLLC

(57) ABSTRACT

A printing apparatus that can prevent unexpected operation of an element is to be achieved. The printing apparatus is provided with: a drive signal generating circuit that can generate a plurality of drive signals, an element to which the plurality of drive signals can be applied and that performs operation for ejecting ink according to the applied drive signals, and a prevention circuit for preventing the plurality of drive signals from being simultaneously applied to the element.

13 Claims, 14 Drawing Sheets

| pixel data | | waveform selection pattern (fine-quality) | | | selec-tion data | waveform selection pattern (high-speed) | | | selec-tion data |
|---|---|---|---|---|---|---|---|---|---|
| no dot (00) | A | T11: × | T12: × | T13: × | 000 | T11: × | T12: × | T13: × | 000 |
| | B | T21: × | T22: × | | 00 | T21: × | T22: × | | 00 |
| small dot (01) | A | T11: × | T12: × | T13: × | 000 | T11: × | T12: ○ | T13: × | 010 |
| | B | T21: × | T22: ○ | | 01 | T21: × | T22: × | | 00 |
| medium dot (10) | A | T11: × | T12: × | T13: × | 000 | T11: ○ | T12: ○ | T13: × | 110 |
| | B | T21: ○ | T22: × | | 10 | T21: × | T22: × | | 00 |
| large dot (11) | A | T11: ○ | T12: ○ | T13: ○ | 111 | T11: ○ | T12: ○ | T13: ○ | 111 |
| | B | T21: × | T22: × | | 00 | T21: × | T22: × | | 00 |

| selection data | | switch actuating signal | |
|---|---|---|---|
| first | second | first | second |
| 0 | 0 | 0 | 0 |
| 0 | 1 | 0 | 1 |
| 1 | 0 | 1 | 0 |
| 1 | 1 | 1 | 0 |

| selection data | | N_CHG | switch actuating signal | |
|---|---|---|---|---|
| first | second | | first | second |
| 0 | 0 | 0 | 0 | 0 |
| 0 | 0 | 1 | 1 | 0 |
| 0 | 1 | 0 | 0 | 1 |
| 0 | 1 | 1 | 0 | 1 |
| 1 | 0 | 0 | 1 | 0 |
| 1 | 0 | 1 | 1 | 0 |
| 1 | 1 | 0 | 1 | 0 |
| 1 | 1 | 1 | 1 | 0 |

| pixel data | | waveform selection pattern | | | | | | selec-tion data |
|---|---|---|---|---|---|---|---|---|
| | | T1 | T2 | T3 | T4 | T5 | T6 | |
| no dot (00) | A | × | × | × | × | × | × | 000000 |
| | B | × | × | × | × | × | × | 000000 |
| small dot (01) | A | × | × | ○ | × | × | × | 001000 |
| | B | × | × | × | × | × | × | 000000 |
| medium dot (10) | A | × | × | ○ | × | × | × | 001000 |
| | B | × | ○ | × | ○ | × | × | 010100 |
| large dot (11) | A | ○ | × | ○ | × | ○ | × | 101010 |
| | B | × | ○ | × | ○ | × | ○ | 010101 |

PRINTING APPARATUS AND PRINTING SYSTEM

CROSS-REFERENCE TO RELATED APPLICATIONS

The present application claims priority upon Japanese Patent Application No. 2004-239411 filed on Aug. 19, 2004, which is herein incorporated by reference.

BACKGROUND OF THE INVENTION

1. Field of the Invention

The present invention relates to printing apparatuses and printing systems.

2. Description of the Related Art

Some printing apparatuses for printing images on a medium have an element to which a plurality of drive signals can be applied. For example, there has been proposed a printing apparatus in which a plurality of types of drive pulses for causing ejection of different amounts of ink are divided into two and contained in two drive signals and the drive pulses to be applied to a piezo element are selected (e.g., see Japanese Laid-Open Patent Publication No. 2000-52570). There has also been proposed a printing apparatus in which a drive pulse that is necessary in forming the largest dot is contained in one drive signal and drive pulses that are necessary in forming other dots are contained in another drive signal (e.g., see Japanese Laid-Open Patent Publication No. 2003-246086).

However, neither of the above-mentioned printing apparatuses gives consideration to cases in which a plurality of drive signals are simultaneously applied to the element. For example, in a configuration in which the number of switches for controlling the application of drive signals is the same as the number of the drive signals and the switches are turned on or off by an actuating signal outputted through a signal line, noise may be applied to the switches through this signal line. In cases where the noise applied to the switches is at a level equal to or above the operating voltage of the switches, the switches may be turned on. Here, when a certain switch has been turned on by an actuating signal for actuating that switch, if another switch is turned on due to the noise, then two drive signals will simultaneously be applied to the piezo element. In such a case, failures such as unexpected operation of the piezo element may occur.

SUMMARY OF THE INVENTION

The present invention was arrived in light of the foregoing matters, and it is an object thereof to achieve a printing apparatus that can prevent unexpected operation of an element.

A main invention for achieving the foregoing object is a printing apparatus comprising: a drive signal generating circuit that can generate a plurality of drive signals, an element to which the plurality of drive signals can be applied and that performs operation for ejecting ink according to the applied drive signals, and a prevention circuit for preventing the plurality of drive signals from being simultaneously applied to the element.

Features of the present invention other than the above will become clear through the description of the present specification with reference to the accompanying drawings.

BRIEF DESCRIPTION OF THE DRAWINGS

For a more complete understanding of the present invention and the advantages thereof, reference is now made to following description taken in conjunction with the accompanying drawings wherein.

DETAILED DESCRIPTION OF THE INVENTION

Overview of the Disclosure

Figure 1:
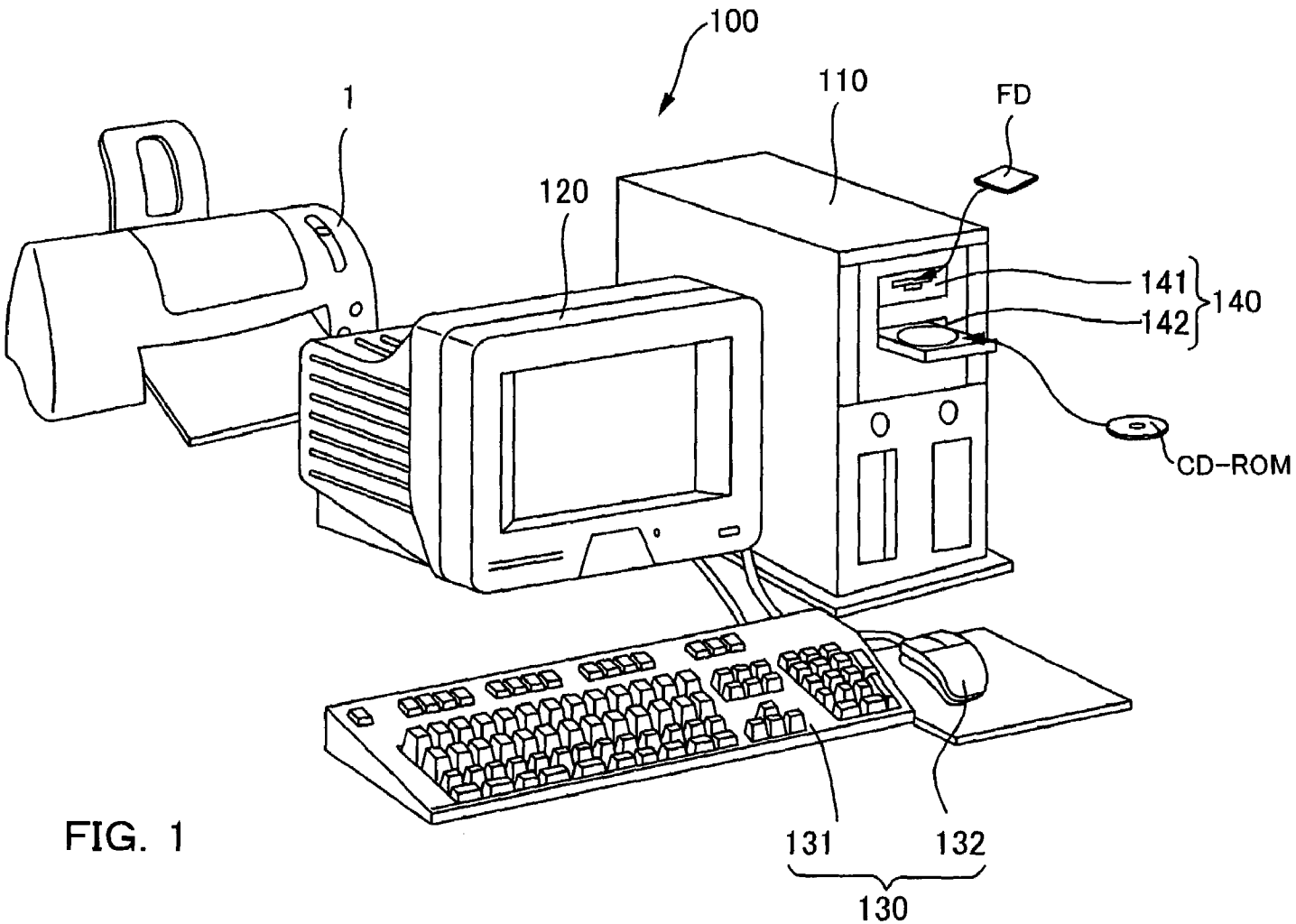
FIG. 1 is a diagram for describing a configuration of a printing system.

At least the following matters will be made clear by the present specification with reference to the accompanying drawings.

That is, it is possible to achieve a printing apparatus comprising: a drive signal generating circuit that can generate a plurality of drive signals, an element to which the plurality of drive signals can be applied and that performs operation for ejecting ink according to the applied drive signals, and a prevention circuit for preventing the plurality of drive signals from being simultaneously applied to the element.

According to this printing apparatus, the prevention circuit prevents a plurality of drive signals from being simultaneously applied to the element. Thus, the element is made to operate by one drive signal. Therefore, it is possible to prevent unexpected operation of the element.

In this printing apparatus, the printing apparatus may comprise: a plurality of switches that are provided in one-to-one correspondence with the plurality of drive signals, each of the switch controlling application of the corresponding drive signal to the element, and a switch controller that outputs, to the prevention circuit, a switch control signal for controlling actuation of the plurality of switches; and the prevention circuit may output, based on the switch control signal inputted thereto, a switch actuating signal for actuating the switches to each of the plurality of switches.

According to this printing apparatus, the same number of switches for controlling application of the drive signals to the element as the number of drive signals are provided. Thus, in order to switch between the drive signals applied to the element, it is only necessary to control actuation of the switches individually. Accordingly, switching can be performed in a short period of time, and thus the present printing apparatus is also suitable for the case where the element is made to operate at a high frequency.

In this printing apparatus, when the switch control signal inputted to the prevention circuit is for simultaneously applying the plurality of drive signals to the element, the prevention circuit may output the switch actuating signal for actuating the switches so that a selected one of the drive signals is applied to the element.

According to this printing apparatus, it is possible to prevent unexpected operation of the element, even when, due to noise etc., the switch control signal indicates that a plurality of drive signals are to be simultaneously applied.

In this printing apparatus, when a forced application signal for applying the drive signals to the element regardless of the switch control signal is inputted to the prevention circuit, the prevention circuit may output the switch actuating signal for actuating the switches so that a selected one of the drive signals is applied to the element.

According to this printing apparatus, it is possible to prevent a failure in which a plurality of drive signals are simultaneously applied to the element, even when the drive signals are to be forcibly applied by the forced application signal.

In this printing apparatus, when the switch control signal indicates, at the timing when the forced application signal is inputted to the prevention circuit, that one of the drive signals is to be applied to the element, the prevention circuit may output the switch actuating signal for actuating the switches so that the drive signal indicated by that switch control signal is applied to the element.

According to this printing apparatus, it is possible to prevent a failure in which a plurality of drive signals are simultaneously applied to the element, even when the drive signals are to be forcibly applied by the forced application signal.

In this printing apparatus, when the switch control signal indicates, at the timing when the forced application signal is inputted to the prevention circuit, that a plurality of the drive signals are to be applied to the element, the prevention circuit may output the switch actuating signal for actuating the switches so that a particular one of the drive signals is applied to the element.

According to this printing apparatus, it is possible to prevent a failure in which a plurality of drive signals are simultaneously applied to the element, even when the drive signals are to be forcibly applied by the forced application signal.

In this printing apparatus, the switch controller may output the switch control signal based on gradation data indicating a gradation level of a dot to be formed by the ejected ink.

According to this printing apparatus, ink can be ejected with high accuracy.

In this printing apparatus, the switch controller may output the switch control signal for each of the plurality of drive signals.

According to this printing apparatus, a desired segment of the drive signals can be applied to the element, and thus various controls can be realized.

In this printing apparatus, the switch controller may output at least two switch control signals asynchronously with each other.

According to this printing apparatus, the combination of segments of the drive signals that are applied to the element can be diversified, and thus various controls can be realized.

In this printing apparatus, the switch controller may output all of the plurality of the switch control signals synchronously.

According to this printing apparatus, control can be simplified.

In this printing apparatus, the prevention circuit may be constituted by a logic circuit.

According to this printing apparatus, it is possible to increase the speed of the operation of the prevention circuit, and thus the present printing apparatus is suitable for ejection of ink at a high frequency.

In this printing apparatus, it is preferable that the element is a piezo element.

It is also possible to achieve a printing apparatus comprising: a drive signal generating circuit that can generate a plurality of drive signals, an element to which the plurality of drive signals can be applied and that performs operation for ejecting ink according to the applied drive signals, a prevention circuit for preventing the plurality of drive signals from being simultaneously applied to the element, a plurality of switches that are provided in one-to-one correspondence with the plurality of drive signals, each of the switch controlling application of the corresponding drive signal to the element, and a switch controller that outputs, to the prevention circuit, a switch control signal for controlling actuation of the plurality of switches; wherein the element is a piezo element; wherein the prevention circuit is constituted by a logic circuit, and outputs, based on the switch control signal inputted thereto, a switch actuating signal for actuating the switches to each of the plurality of switches; wherein when the switch control signal inputted to the prevention circuit is for simultaneously applying the plurality of drive signals to the element, the prevention circuit outputs, to each of the plurality of switches, the switch actuating signal for actuating the switches so that a selected one of the drive signals is applied to the element; wherein when a forced application signal for applying the drive signals to the element regardless of the switch control signal is inputted to the prevention circuit, the prevention circuit outputs the switch actuating signal for actuating the switches so that a selected one of the drive signals is applied to the element; wherein when the switch control signal indicates, at the timing when the forced application signal is inputted to the prevention circuit, that one of the drive signals is to be applied to the element, the prevention circuit outputs the switch actuating signal for actuating the switches so that the drive signal indicated by that switch control signal is applied to the element; wherein when the switch control signal indicates, at the timing when the forced application signal is inputted to the prevention circuit, that a plurality of the drive signals are to be applied to the element, the prevention circuit outputs the switch actuating signal for actuating the switches so that a particular one of the drive signals is applied to the element; wherein the switch controller outputs the switch control signal based on gradation data indicating a gradation level of a dot to be formed by the ejected ink; wherein the switch controller outputs the switch control signal for each of the plurality of drive signals; and wherein the switch controller outputs at least two switch control signals asynchronously with each other, or all of the plurality of the switch control signals synchronously.

According to this printing apparatus, almost all of the above-mentioned effects can be attained, so that the object of the present invention is achieved most effectively.

It is also possible to achieve a printing system comprising: a printing apparatus that includes a drive signal generating circuit that can generate a plurality of drive signals, an element to which the plurality of drive signals can be applied and that performs operation for ejecting ink according to the applied drive signals, and a prevention circuit for preventing the plurality of drive signals from being simultaneously applied to the element; and a print control apparatus that controls operations of the printing apparatus.

Configuration of Printing System

<Regarding the Overall Configuration>

First, a printing apparatus will be described in conjunction with a printing system. It should be noted that the printing system refers to a system including at least a printing apparatus and a print control apparatus for controlling the operation of this printing apparatus.

FIG. 1 is a diagram for describing a configuration of a printing system 100. The illustrated printing system 100 includes a printer 1 serving as the printing apparatus and a computer 110 serving as the print control apparatus. More specifically, this printing system 100 has the printer 1, the computer 110, a display device 120, an input device 130, and a record/play device 140.

The printer 1 is for printing images on a medium such as paper, cloth, and film. Regarding this medium, paper S (see FIG. 3A), which is a representative medium, is taken as an example in the following description. The computer 110 is communicably connected to the printer 1. In order to make the printer 1 print an image, the computer 110 outputs print data corresponding to that image to the printer 1. This computer 110 has computer programs, such as an application program and a printer driver, installed thereon. The display device 120 has a display. This display device 120 is, for example, for displaying a user interface of the computer programs. The input device 130 is, for example, a keyboard 131 and a mouse 132. The record/play device 140 is, for example, a flexible disk drive device 141 and a CD-ROM drive device 142.

Computer

<Regarding the Configuration of the Computer 110>

Figure 2:
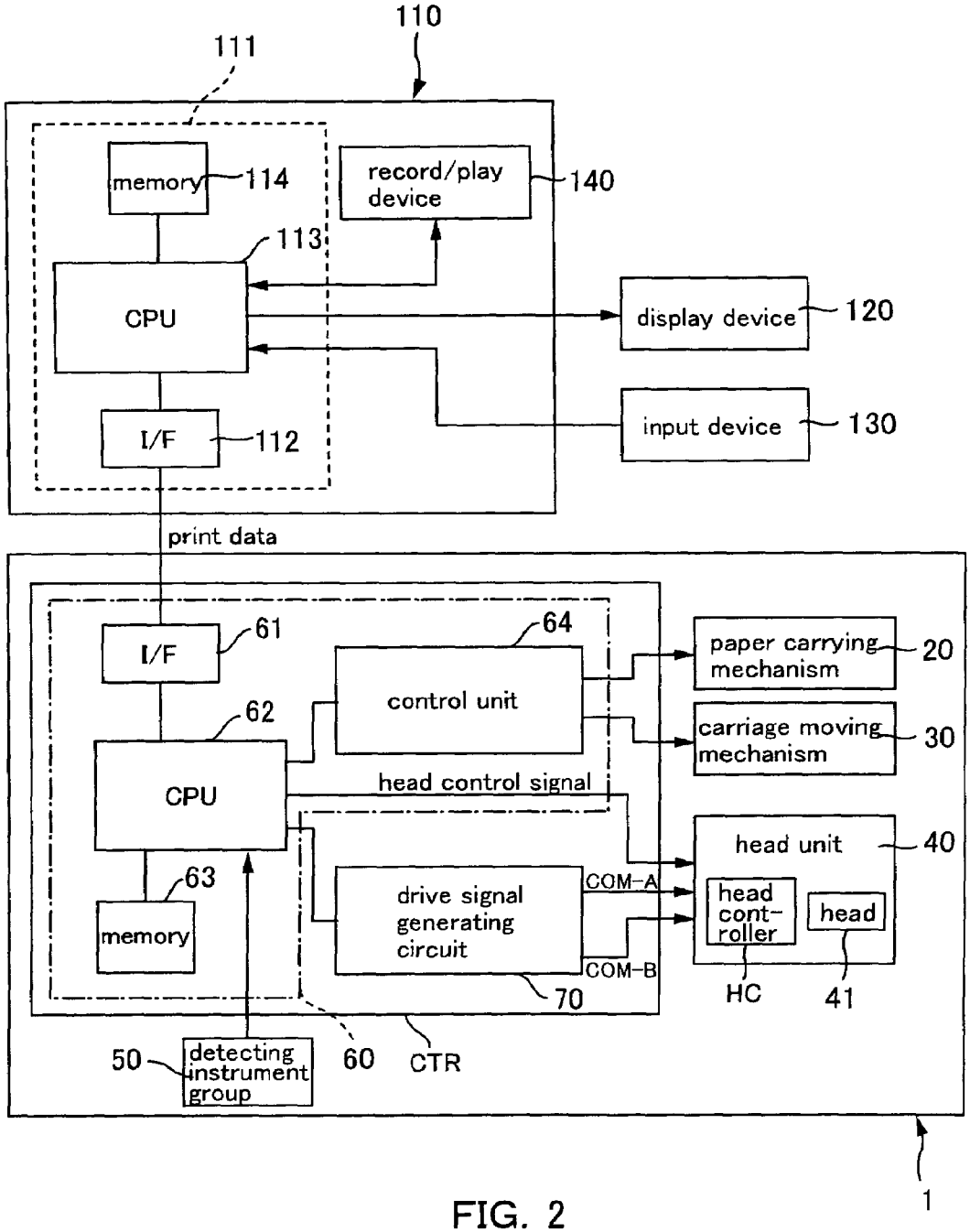
FIG. 2 is a block diagram for describing configurations of a computer and a printer.

FIG. 2 is a block diagram for describing configurations of the computer 110 and the printer 1. First, the configuration of the computer 110 will be described briefly.

This computer 110 has the above-mentioned record/play device 140 and a host-side controller 111. The record/play device 140 is communicably connected to the host-side controller 111, and mounted in a housing of the computer 110, for example. The host-side controller 111 performs various controls in the computer 110, and the above-mentioned display device 120 and input device 130 also are communicably connected to this host-side controller. The host-side controller 111 has an interface section 112, a CPU 113, and a memory 114. The interface section 112 serves as an interface with the printer 1, and exchanges data with the printer 1. The CPU 113 is a computing processing unit for performing overall control of the computer 110. The memory 114 is for reserving an area for storing the computer programs used by the CPU 113 and a working area, for example, and is constituted by a RAM, an EEPROM, a ROM, a magnetic disk device, and the like. Examples of the computer programs stored on the memory 114 include the application program and the printer driver, as described above. The CPU 113 performs various controls according to the computer programs stored on the memory 114.

The printer driver allows the computer 110 to realize a function of converting image data outputted from the application program into print data. The printer 1 carries out printing operation when it receives the print data from the computer 110. In other words, the computer 110 controls the operation of the printer 1 via the print data. Therefore, the printer driver makes the computer 110 function as the print control apparatus. The printer driver has a code for realizing the function of converting the image data into the print data.

The print data is data having a format that can be interpreted by the printer 1, and has various types of command data and pixel data. The command data is data for instructing the printer 1 to carry out a particular operation. Examples of the command data include command data for instructing paper-supply, command data for indicating the carry amount, and command data for instructing paper-discharge. The pixel data is data about pixels of the image to be printed. Here, "pixels" refer to square grids that are defined on paper in a virtual manner. These pixels indicate regions where dots are to be formed. The pixel data in the print data is converted into data about dots to be formed on the paper (e.g., data of the size of the dots). In the present embodiment, the pixel data is constituted by data of two bits. That is to say, the pixel data includes pixel data "00" indicating formation of no dot, pixel data "01" indicating formation of a small dot, pixel data "10" indicating formation of a medium dot, and pixel data "11" indicating formation of a large dot. Therefore, the printer 1 of the present embodiment can form dots in a four-level gradation.

The printer driver performs resolution conversion processing, color conversion processing, halftone processing, rasterization processing, and so on, in order to convert the image data outputted from the application program into the print data. Moreover, the printer driver is provided in a state in which it is recorded on a storage medium (computer-readable storage medium) such as a flexible disk FD or a CD-ROM. Moreover, the printer driver also can be downloaded onto the computer 110 via the Internet.

Printer <Regarding the Configuration of the Printer 1>

Figure 3A:
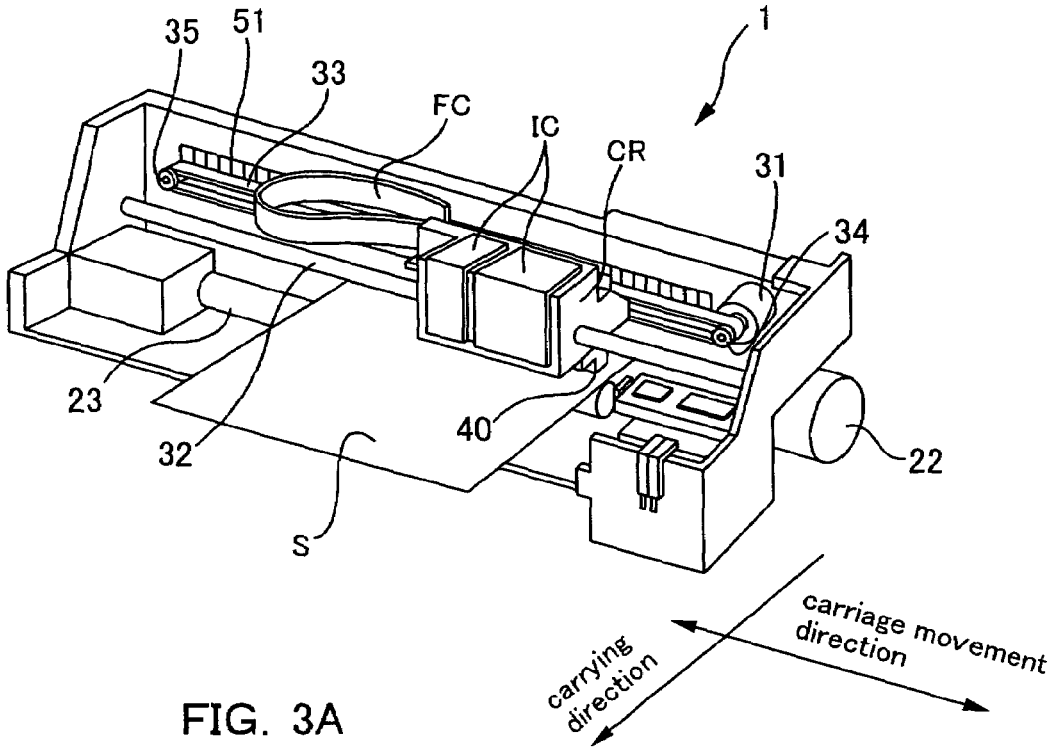
FIG. 3A is a diagram showing a configuration of the printer of the present embodiment.
Figure 3B:
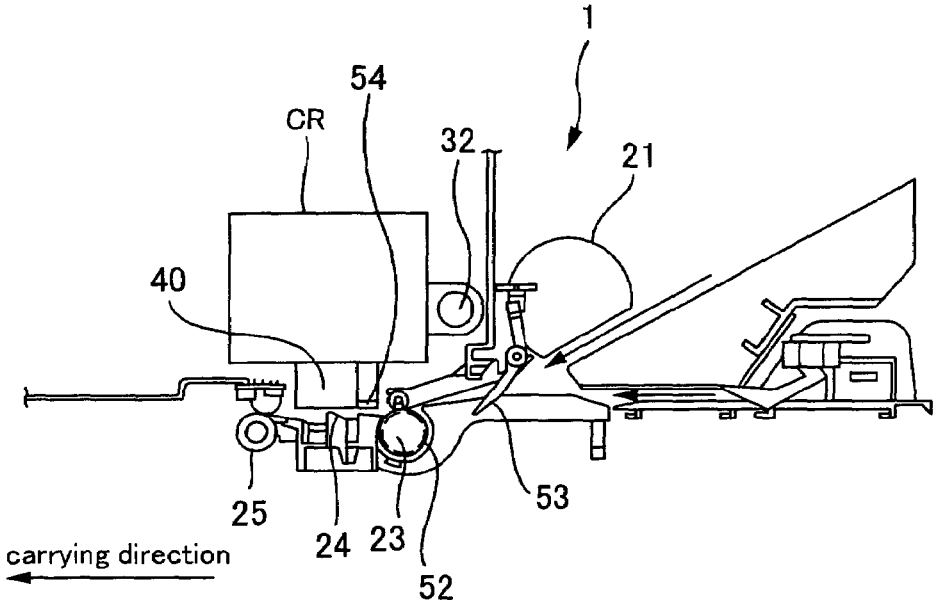
FIG. 3B is a transverse cross-sectional view of an overall configuration of the printer of the present embodiment.

Next, the configuration of the printer 1 will be described. Here, FIG. 3A is a diagram showing the configuration of the printer 1 of the present embodiment. FIG. 3B is a transverse cross-sectional view of an overall configuration of the printer 1 of the present embodiment. In the following description, reference will also be made to the block diagram of FIG. 2.

As shown in FIG. 2, the printer 1 has a paper carrying mechanism 20, a carriage moving mechanism 30, a head unit 40, a detecting instrument group 50, a printer-side controller 60, and a drive signal generating circuit 70. In the present embodiment, the printer-side controller 60 and the drive signal generating circuit 70 are provided on a common controller board CTR. Moreover, the head unit 40 has a head controller HC and a head 41.

In the printer 1, the sections to be controlled, i.e., the paper carrying mechanism 20, the carriage moving mechanism 30, the head unit 40 (head controller HC, head 41), and the drive signal generating circuit 70, are controlled by the printer-side controller 60. Thus, based on the print data received from the computer 110, the printer-side controller 60 performs control so that the image is printed on the paper S. Moreover, detecting instruments in the detecting instrument group 50 monitor the conditions in the printer 1. Then, the detecting instruments output detection results to the printer-side controller 60. The printer-side controller 60 that has received the detection results from the detecting instruments controls the sections to be controlled based on the detection results.

The paper carrying mechanism 20 corresponds to a medium carrying section for carrying a medium. The paper carrying mechanism 20 is for feeding the paper S into a printable position and carrying the paper S in a carrying direction by a predetermined carry amount. This carrying direction is a direction that intersects with a carriage movement direction that will be described below. As shown in FIG. 3A and FIG. 3B, the paper carrying mechanism 20 has a paper feed roller 21, a carry motor 22, a carry roller 23, a platen 24, and a paper discharge roller 25. The paper feed roller 21 is a roller for automatically feeding, into the printer 1, the paper S that has been inserted into a paper insert opening, and has a D-shaped cross-sectional shape in this example. The carry motor 22 is a motor for carrying the papers in the carrying direction, and the operation thereof is controlled by the printer-side controller 60. The carry roller 23 is a roller for carrying the paper S that has been fed by the paper feed roller 21 to a printable region. The operation of the carry roller 23 is also controlled by the printer-side controller 60. The platen 24 is a member for supporting the paper S from the rear surface thereof during printing. The paper discharge roller 25 is a roller for carrying the paper S for which printing has finished.

The carriage moving mechanism 30 is for moving a carriage CR to which the head unit 40 is attached in the carriage movement direction. The carriage movement direction includes a movement direction from one side to the other side and a movement direction opposite thereto. It should be noted that since the head unit 40 has the head 41, the carriage movement direction corresponds to a direction in which the head 41 moves, and the carriage moving mechanism 30 corresponds to a head moving section for moving the head 41 in the movement direction. The carriage moving mechanism 30 has a carriage motor 31, a guide shaft 32, a timing belt 33, a driving pulley 34, and a driven pulley 35. The carriage motor 31 corresponds to a drive source for moving the carriage CR. The operation of the carriage motor 31 is controlled by the printer-side controller 60. The driving pulley 34 is attached to the rotation axis of the carriage motor 31. The driving pulley 34 is disposed on one end side of the carriage movement direction. On the other end side of the carriage movement direction, which is opposite to the side on which the driving pulley 34 is disposed, there is disposed the driven pulley 35. The timing belt 33 is connected to the carriage CR and extended between the driving pulley 34 and the driven pulley 35. The guide shaft 32 supports the carriage CR in a manner in which the carriage CR can move. This guide shaft 32 is attached along the carriage movement direction. Therefore, when the carriage motor 31 operates, the carriage CR moves along the guide shaft 32 in the carriage movement direction.

Figure 4:
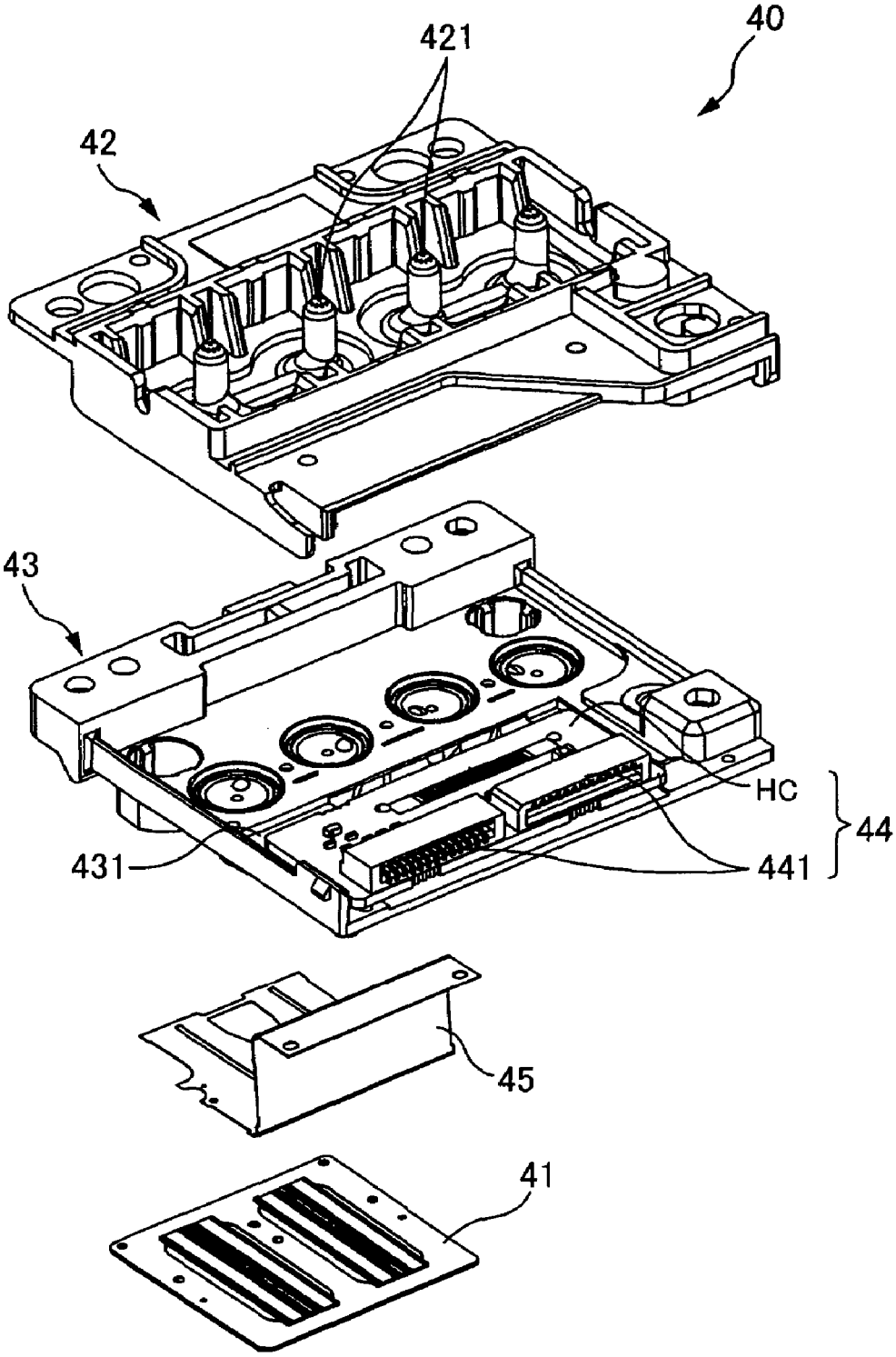
FIG. 4 is an exploded perspective view of a head unit.
Figure 5A:
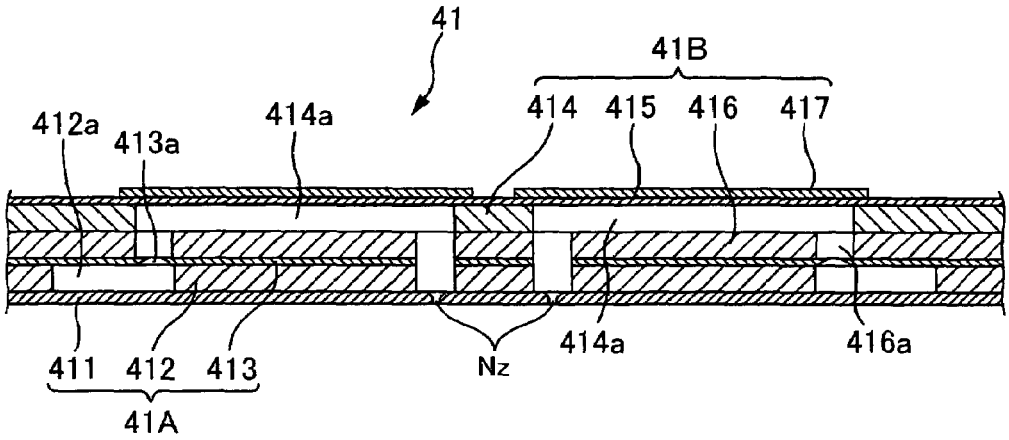
FIG. 5A is a cross-sectional view for describing a structure of a head.
Figure 5B:
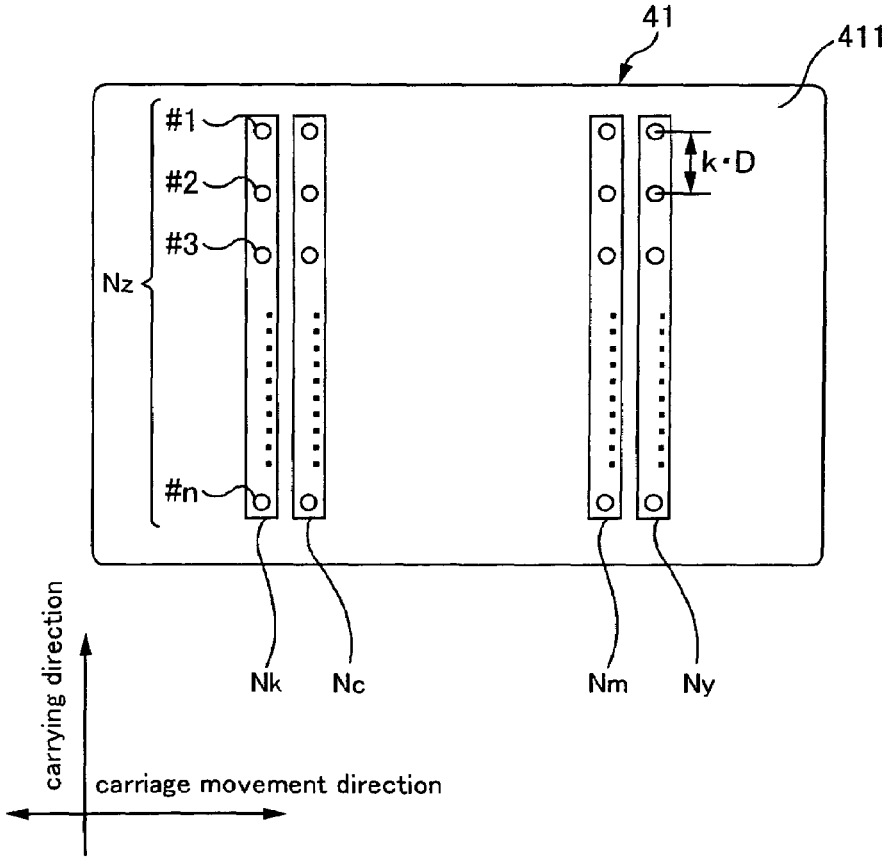
FIG. 5B is a diagram for describing an arrangement of nozzles.

The head unit 40 is for causing ejection of ink toward the paper S. Here, FIG. 4 is an exploded perspective view of the head unit 40. FIG. 5A is a cross-sectional view for describing a structure of the head 41. FIG. 5B is a diagram for describing an arrangement of nozzles Nz.

The head unit 40 has a structure shown in FIG. 4, for example. That is to say, the head unit 40 has the head 41, a needle-side casing member 42 and a head-side casing member 43. The needle-side casing member 42 is a member having ink supply needles 421 that are inserted into ink cartridges IC (see FIG. 3A), and can be made, for example, by molding a resin. The head-side casing member 43 is a member to which the head 41 is attached, and can be made, for example, by molding a resin. A board arrangement section 431 is provided on the head-side casing member 43. The board arrangement section 431 is a portion where a head control board 44 is arranged, and is formed as a depression having a substantially rectangular shape. The head control board 44 and the head 41 are electrically connected to each other by a film-like head-side wiring member 45. That is to say, one end portion of the head-side wiring member 45 is electrically connected to piezo elements 417 (PZT, see FIG. 5A) of the head 41, and the other end portion thereof is electrically connected to the head control board 44. The head controller HC (sub-controller), which is for controlling the head 41, and connectors 441 are provided on the head control board 44. The head controller HC will be described later. The head control board 44 and the printer-side controller 60 are electrically connected to each other via a film-like controller-side wiring board FC (see FIG. 3A).

The head 41 included in the head unit 40 has the structure shown in FIG. 5A, for example. The illustrated head 41 has a channel unit 41A and an actuator unit 41B. The channel unit 41A has a nozzle plate 411 in which the nozzles Nz are provided, a reservoir forming substrate 412 in which openings serving as ink reservoirs 412*a* are formed, and a supply-port forming substrate 413 in which ink supply ports 413*a* are formed. The nozzle plate 411 is bonded to one surface of the reservoir forming substrate 412, and the supply-port forming substrate 413 is bonded to the other surface thereof. The actuator unit 41B has a pressure-chamber forming substrate 414 in which openings serving as pressure chambers 414*a* are formed, a vibration plate 415 for partitioning a portion of the pressure chambers 414*a*, a cover member 416 in which openings serving as supply-side communicating holes 416*a* are formed, and the piezo elements 417 formed on the surface of the vibration plate 415. Thus, in the head 41, continuous channels leading from the ink reservoirs 412*a* via the pressure chambers 414*a* to the nozzles Nz are formed. At the time of use, these channels are filled up with ink, and by changing the shape of the piezo elements 417, ink can be ejected from the corresponding nozzles Nz. Therefore, in this head 41, each of the piezo elements 417 corresponds to the element that performs the operation for ejecting ink.

Moreover, as shown in FIG. 5B, the nozzles Nz are divided into groups by type of ink ejected from the nozzles Nz, and each group constitutes a nozzle row. The illustrated head 41 has four nozzle rows consisting of a black ink nozzle row Nk, a cyan ink nozzle row Nc, a magenta ink nozzle row Nm, and a yellow ink nozzle row Ny, and can eject ink in four colors. Each nozzle row has n (n=180 in the present embodiment) nozzles Nz. In these nozzle rows, the nozzles Nz are arranged along a predetermined arrangement direction (carrying direction, in this example) with a constant spacing (nozzle pitch: k·D). Here, D is the minimum dot pitch in the carrying direction, i.e., the spacing of the dots formed on the paper S at the highest resolution. Moreover, k is a coefficient indicating the relationship between the minimum dot pitch D and the nozzle pitch, and is set to an integer of 1 or more.

Moreover, in the printer 1, it is possible to perform four types of controls, i.e., formation of no dot, which is associated with the pixel data "00", formation of a small dot, which is associated with the pixel data "01", formation of a medium dot, which is associated with the pixel data "10", and formation of a large dot, which is associated with the pixel data "11", as described above. Thus, it is possible to make each nozzle Nz eject a plurality of types of ink, each type having a different ink amount. For example, it is possible to make each nozzle Nz eject three types of ink, i.e., a large ink droplet containing the amount of ink that can form a large dot, a medium ink droplet containing the amount of ink that can form a medium dot, and a small ink droplet containing the amount of ink that can form a small dot. The relationship between the pixel data and ink to be ejected will be described later.

The detecting instrument group 50 is for monitoring the conditions in the printer 1. The detecting instrument group 50 includes a linear encoder 51, a rotary encoder 52, a paper detector 53, and a paper width detector 54, for example. The linear encoder 51 is for detecting the position of the carriage CR (head 41, nozzles Nz) in the carriage movement direction. The rotary encoder 52 is for detecting the amount of rotation of the carry roller 23. The paper detector 53 is for detecting the position of the front end of the paper S to be printed. The paper width detector 54 is a sensor for detecting the width of the paper S to be printed.

The printer-side controller 60 performs control of the printer 1. The printer-side controller 60 corresponds to a controller for applying drive signals COM (first drive signal COM_A and second drive signal COM_B; see FIG. 12A) to the piezo elements 417. Moreover, the printer-side controller 60 has, as shown in FIG. 2, an interface section 61, a CPU 62, a memory 63, and a control unit 64. The interface section 61 exchanges data with the computer 110, which is an external apparatus. The CPU 62 is a computing processing unit for performing the overall control of the printer 1. The memory 63 is for reserving an area for storing the programs for the CPU 62 and a working area, for example, and is constituted by storage elements such as a RAM, an EEPROM, and a ROM. The CPU 62 controls the sections to be controlled according to the computer programs stored on the memory 63. For example, the CPU 62 controls the paper carrying mechanism 20 and the carriage moving mechanism 30 via the control unit 64. Moreover, the CPU 62 outputs, to the head controller HC, head control signals (clock signal CLK, pixel data SI, latch signal LAT, first change signal CH_A, second change signal CH_B, all-ON signal N_CHG; see FIG. 10) for controlling the operation of the head 41. Furthermore, the CPU 62 outputs a control signal for generating the drive signals COM to the drive signal generating circuit 70.

Figure 6:
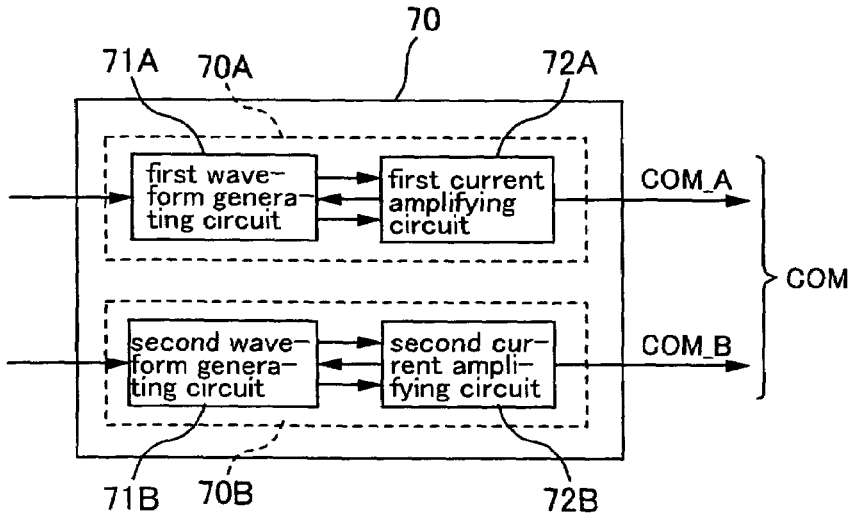
FIG. 6 is a block diagram for describing a configuration of a drive signal generating circuit.

The drive signal generating circuit 70 generates the drive signals COM to be used in common. The drive signals COM in the present embodiment are used in common for all of the piezo elements 417 associated with one nozzle row. Here, FIG. 6 is a block diagram for describing a configuration of the drive signal generating circuit 70.

The drive signal generating circuit 70 can simultaneously generate a plurality of types of drive signals COM. The drive signal generating circuit 70 of the present embodiment has a first drive signal generating section 70A for generating the first drive signal COM_A and a second drive signal generating section 70B for generating the second drive signal COM_B. The first drive signal generating section 70A has a first waveform generating circuit 71A and a first current amplifying circuit 72A, and the second drive signal generating section 70B has a second waveform generating circuit 71B and a second current amplifying circuit 72B. It should be noted that the first waveform generating circuit 71A and the second waveform generating circuit 71B have the same configuration, and the first current amplifying circuit 72A and the second current amplifying circuit 72B have the same configuration. Therefore, in the following description, the first waveform generating circuit 71A and the first current amplifying circuit 72A will be mainly discussed.

Figure 7:
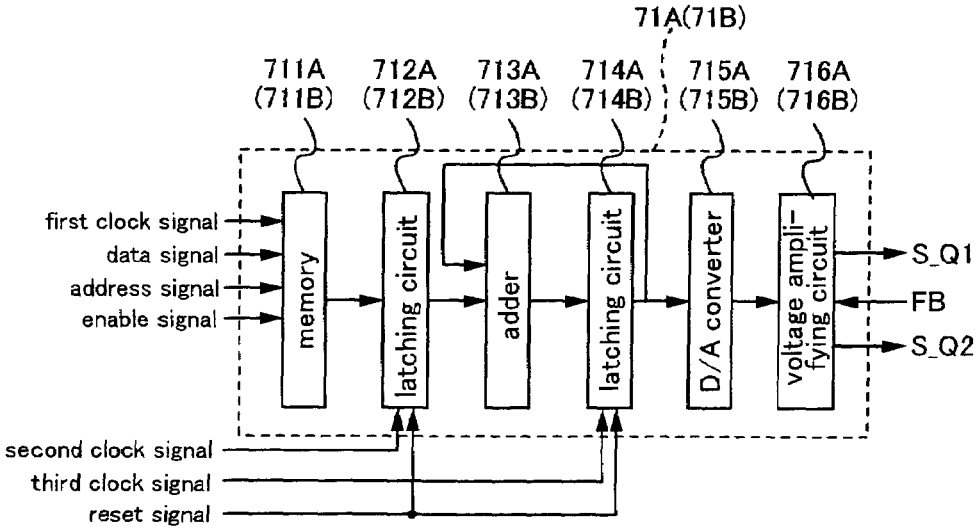
FIG. 7 is a block diagram for describing a configuration of a first waveform generating circuit and a second waveform generating circuit.

FIG. 7 is a block diagram for describing a configuration of the first waveform generating circuit 71A and the second waveform generating circuit 71B. It should be noted that the components of the second waveform generating circuit 71B are indicated by the parenthesized numerals. The first waveform generating circuit 71A has a memory 711A, a first latching circuit 712A, an adder 713A, a second latching circuit 714A, a digital-analog converter (D/A converter) 715A, and a voltage amplifying circuit 716A.

The memory 711A stores a plurality of types of data about the voltage change amount in association with addresses. The memory 711A has a first clock signal input terminal, a data signal input terminal, an address signal input terminal, an enable signal input terminal, and a data signal output terminal. A data signal indicates the voltage change amount. An address signal indicates a storage address to which the data about the voltage change amount is stored or a read address for the data about the voltage change amount to be read out. The memory 711A stores the data about the voltage change amount to the storage address specified by the address signal. The data about the voltage change amount is stored by inputting required signals to the first clock signal input terminal, the data signal input terminal, the address signal input terminal, and the enable signal input terminal. Moreover, the memory 711A outputs the data about the voltage change amount designated by the read address to the first latching circuit 712A. This read address is also designated by the address signal inputted to the address signal input terminal.

The first latching circuit 712A is electrically connected to the memory 711A, and reads out the data about the voltage change amount stored on the memory 711A, every time a second clock signal is inputted thereto. In other words, it latches the data about the voltage change amount that has been outputted from the memory 711A. An output of the first latching circuit 712A and an output of the second latching circuit 714A are inputted to the adder 713A. Then, an output of the adder 713A is inputted to the second latching circuit 714A. That is to say, the adder 713A outputs an addition value obtained by adding the output of the first latching circuit 712A and the output of the second latching circuit 714A. The second latching circuit 714A latches the addition value outputted from the adder 713A, every time a third clock signal is inputted thereto.

The digital-analog converter 715A converts the output of the second latching circuit 714A, i.e., the addition value outputted from the adder 713A, into an analog signal. The voltage amplifying circuit 716A is electrically connected to an output of the digital-analog converter 715A. The voltage amplifying circuit 716A amplifies the voltage of the analog signal outputted from the digital-analog converter 715A to a voltage that can drive the piezo elements 417.

Figure 8:
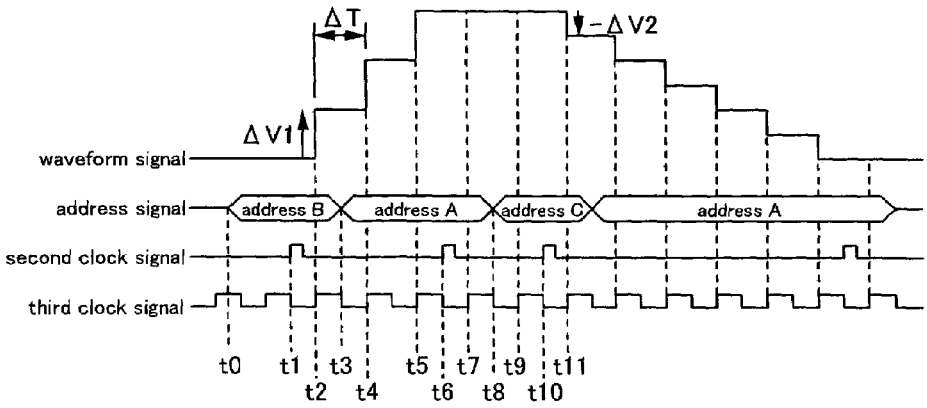
FIG. 8 is a diagram for describing the operation of the first waveform generating circuit.

Next, a specific example of the operation of the first waveform generating circuit 71A will be described. More specifically, the operations of the memory 711A, the first latching circuit 712A, the adder 713A, and the second latching circuit 714A will be described. Here, FIG. 8 is a diagram for describing the operation of the first waveform generating circuit 71A.

The CPU 62 of the printer-side controller 60 outputs an address signal to the memory 711A. The memory 711A outputs data at a read address designated by the address signal (t0−). In this example, the CPU 62 outputs an address signal indicating an address B, and the memory 711A outputs a voltage value ΔV1 as the data about the voltage change amount. Next, the CPU 62 switches the second clock signal to an H level (t1). That is to say, it outputs a clock pulse. The first latching circuit 712A that has received this clock pulse latches the voltage value ΔV1. After this, the CPU 62 changes the read address (t3−). In this way, the CPU 62 outputs an address signal indicating an address A, and the memory 711A outputs a voltage value 0 as the data about the voltage change amount. Moreover, the CPU 62 switches the third clock signal to the H level at a cycle of ΔT. That is to say, it outputs a clock pulse. Every time the second latching circuit 714A receives this clock pulse, the output thereof is increased by the voltage ΔV1 (t2, t4, t5).

Next, the CPU 62 switches the second clock signal to the H level (t6). The first latching circuit 712A that has received this clock pulse latches the voltage value 0 corresponding to the address A. Thus, even when the third clock signal is switched to the H level, the output of the second latching circuit 714A is maintained at a constant potential (t7, t9). Moreover, the CPU 62 changes the read address to an address C (t8−) to make the memory 711A output a voltage value −ΔV2 as the data about the voltage change amount. This voltage value −ΔV2 is latched by the first latching circuit 712A at the timing when the second clock signal is turned to the H level the next time (t10). Thus, every time the third clock signal is turned to the H level, the output of the second latching circuit 714A is decreased by the voltage −ΔV2 (t11−).

Figure 9A:
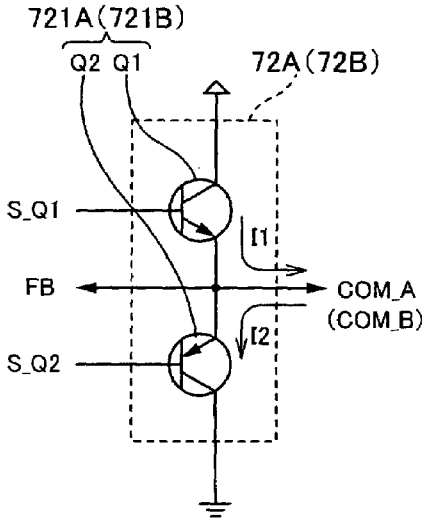
FIG. 9A is a diagram for describing a configuration of a current amplifying circuit.
Figure 9B:
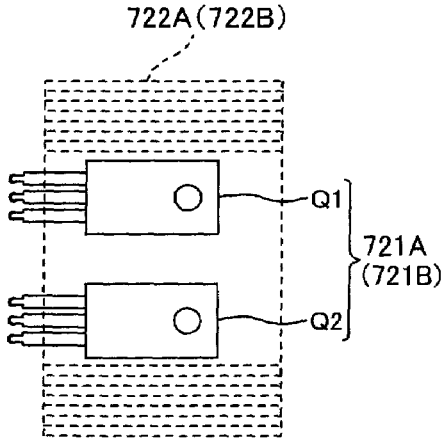
FIG. 9B is a diagram for describing configurations of a transistor pair and a heat sink.

Next, the first current amplifying circuit 72A will be described. Here, FIG. 9A is a diagram for describing a configuration of the current amplifying circuits 72A and 72B. FIG. 9B is a diagram for describing configurations of transistor pairs 721A and 721B and heat sinks 722A and 722B.

As shown in FIG. 9A, the first current amplifying circuit 72A has a first transistor pair 721A that generates heat with a change in the potential of the first drive signal COM_A. The first transistor pair 721A has an NPN transistor Q1 and a PNP transistor Q2 whose emitter terminals are connected to each other. The NPN transistor Q1 is a transistor that operates when the potential of the drive signal COM increases. A collector and an emitter of the NPN transistor Q1 are connected to a power source and an output signal line for the first drive signal COM_A, respectively. The PNP transistor Q2 is a transistor that operates when the potential decreases. A collector and an emitter of the PNP transistor Q2 are connected to the ground (earth) and the output signal line for the first drive signal COM_A, respectively. It should be noted that the potential at a junction of the emitters of the NPN transistor Q1 and the PNP transistor Q2 (potential of first drive signal COM_A) is fed back to the voltage amplifying circuit 716A, as shown by a sign FB.

The operation of the first current amplifying circuit 72A, i.e., the first transistor pair 721A, is controlled by an output signal from the first waveform generating circuit 71A. For example, when the potential of the output signal is increasing, the NPN transistor Q1 is turned on by a control signal S_Q1. Accordingly, the potential of the first drive signal COM_A also increases. On the other hand, when the potential of the output signal is decreasing, the PNP transistor Q2 is turned on by a control signal S_Q2. Accordingly, the potential of the first drive signal COM_A also decreases. It should be noted that when the potential of the output signal is kept constant, both the NPN transistor Q1 and the PNP transistor Q2 are turned off. Consequently, the first drive signal COM_A is kept at a constant potential.

Moreover, a common heat sink 722A is attached to the first transistor pair 721A. That is to say, the heat sink 722A is in contact with both the NPN transistor Q1 and the PNP transistor Q2 that constitute the first transistor pair 721A. The heat sink 722A dissipates, to the outside, heat generated by these NPN transistor Q1 and PNP transistor Q2.

Next, the second waveform generating circuit 71B and the second current amplifying circuit 72B will be described briefly. As described above, the configuration of the second waveform generating circuit 71B is the same as that of the first waveform generating circuit 71A, and the configuration of the second current amplifying circuit 72B is the same as that of the first current amplifying circuit 72A. That is to say, the second waveform generating circuit 71B has a memory 711B, a first latching circuit 712B, an adder 713B, a second latching circuit 714B, a digital-analog converter 715B, and a voltage amplifying circuit 716B. Moreover, the second current amplifying circuit 72B has a second transistor pair 721B that generates heat with a change in the potential of the second drive signal COM_B. The second transistor pair 721B has an NPN transistor Q1 and a PNP transistor Q2 whose emitter terminals are connected to each other. Moreover, a common heat sink 722B is attached to the second transistor pair 721B.

Figure 10:
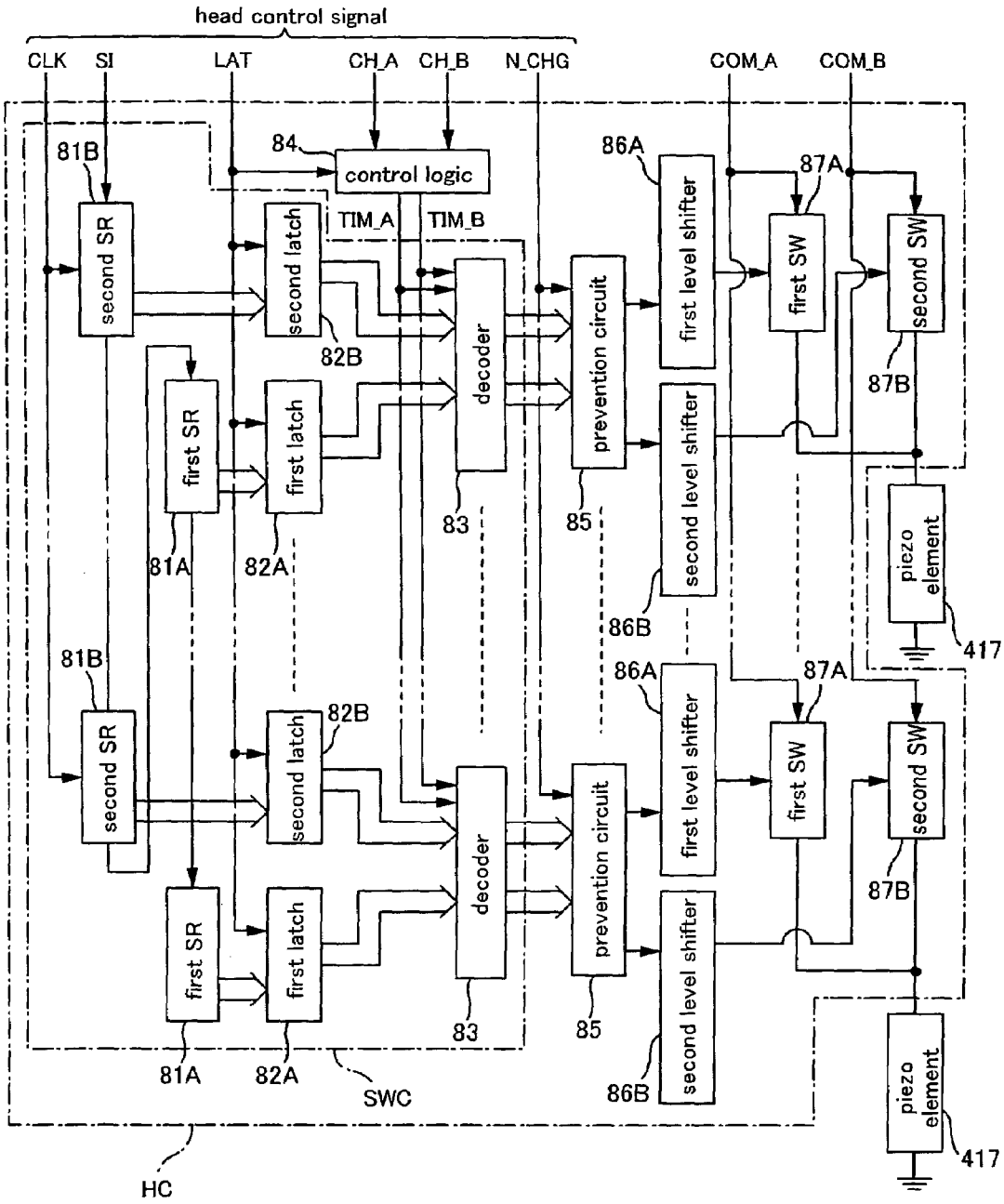
FIG. 10 is a block diagram for describing a configuration of a head controller.

Next, the head controller HC will be described. Here, FIG. 10 is a block diagram for describing a configuration of the head controller HC. As shown in FIG. 10, the head controller HC is provided with a first shift register 81A, a second shift resistor 81B, a first latching circuit 82A, a second latching circuit 82B, a decoder 83, a control logic 84, a prevention circuit 85, a first level shifter 86A, a second level shifter 86B, a first switch 87A, and a second switch 87B. The sections other than the control logic 84, i.e., the first shift register 81A, the second shift resistor 81B, the first latching circuit 82A, the second latching circuit 82B, the decoder 83, the prevention circuit 85, the first level shifter 86A, the second level shifter 86B, the first switch 87A, and the second switch 87B, are provided for each piezo element 417. Since a piezo element 417 is provided for each nozzle Nz from which ink is ejected, these sections also are provided for each nozzle Nz.

The head controller HC performs control for ejecting ink based on the print data (pixel data SI) from the printer-side controller 60. In the present embodiment, the pixel data is constituted by two bits, and the pixel data is transmitted to the recording head 41 in synchronization with the clock signal CLK. The pixel data is transmitted in order from a high-order bit group to a low-order bit group. For example, the pixel data is transmitted in the order of a high-order bit for a nozzle Nz (#1), a high-order bit for a nozzle Nz (#2), . . . , a high-order bit for a nozzle Nz (#179), a high-order bit for a nozzle Nz (#180), a low-order bit for the nozzle Nz (#1), a low-order bit for the nozzle Nz (#2), . . . , a low-order bit for the nozzle Nz (#179), and a low-order bit for the nozzle Nz (#180). Thus, the high-order bit group of the pixel data is firstly set in the second shift registers 81B. When the high-order bit group of the pixel data for all of the nozzles Nz has been set in the second shift registers 81B, the low-order bit group of the pixel data is subsequently set in the second shift registers 81B. As the low-order bit group of the pixel data is set, the high-order bit group of the pixel data is shifted and set in the first shift registers 81A.

The first shift register 81A is electrically connected to the first latching circuit 82A, and the second shift register 81B is electrically connected to the second latching circuit 82B.

When the latch signal LAT from the printer-side controller 60 is turned to the H level, that is to say, when a latch pulse is inputted to the first latching circuit 82A and the second latching circuit 82B, the first latching circuit 82A latches the high-order bit of the pixel data, and the second latching circuit 82B latches the low-order bit of the pixel data. The pixel data latched by the first latching circuit 82A and the second latching circuit 82B (a set of the high-order bit and the low-order bit) is input to the decoder 83. The decoder 83 performs decoding based on the high-order bit and the low-order bit of the pixel data, and generates selection data for selecting waveform segments SS11 to SS13 constituting the first drive signal COM_A and waveform segments SS21 and SS22 constituting the second drive signal COM_B (described later; see FIG. 12A).

That is to say, the decoder 83 corresponds to a selection data generating section, and generates the same number of sets of selection data as the number of drive signals, from the 2-bit pixel data (gradation data). In the present embodiment, first selection data corresponding to the first drive signal COM_A is constituted by data of three bits that correspond to the first waveform segment SS11 to the third waveform segment SS13, respectively. On the other hand, second selection data corresponding to the second drive signal COM_B is constituted by data of two bits that correspond to the first waveform segment SS21 and the second waveform segment SS22, respectively. The selection data is for controlling the operation of the first switch 87A and the second switch 87B. Thus, the selection data corresponds to a switch control signal for controlling the operation of a plurality of switches. Therefore, the sections for generating the selection data from the pixel data, i.e., the first shift register 81A, the second shift register 81B, the first latching circuit 82A, the second latching circuit 82B, and the decoder 83, constitute a switch controller SWC. With this configuration, ejection of ink is controlled with high accuracy, based on the gradation data indicating the gradation level of dots. Moreover, the selection data is generated separately as the first selection data for the first switch 87A and the second selection data for the second switch 87B. Accordingly, a desired segment of the drive signals COM (first drive signal COM_A, second drive signal COM_B) can be applied to the piezo elements 417, and thus various controls can be realized.

Figures 12A, 12B:
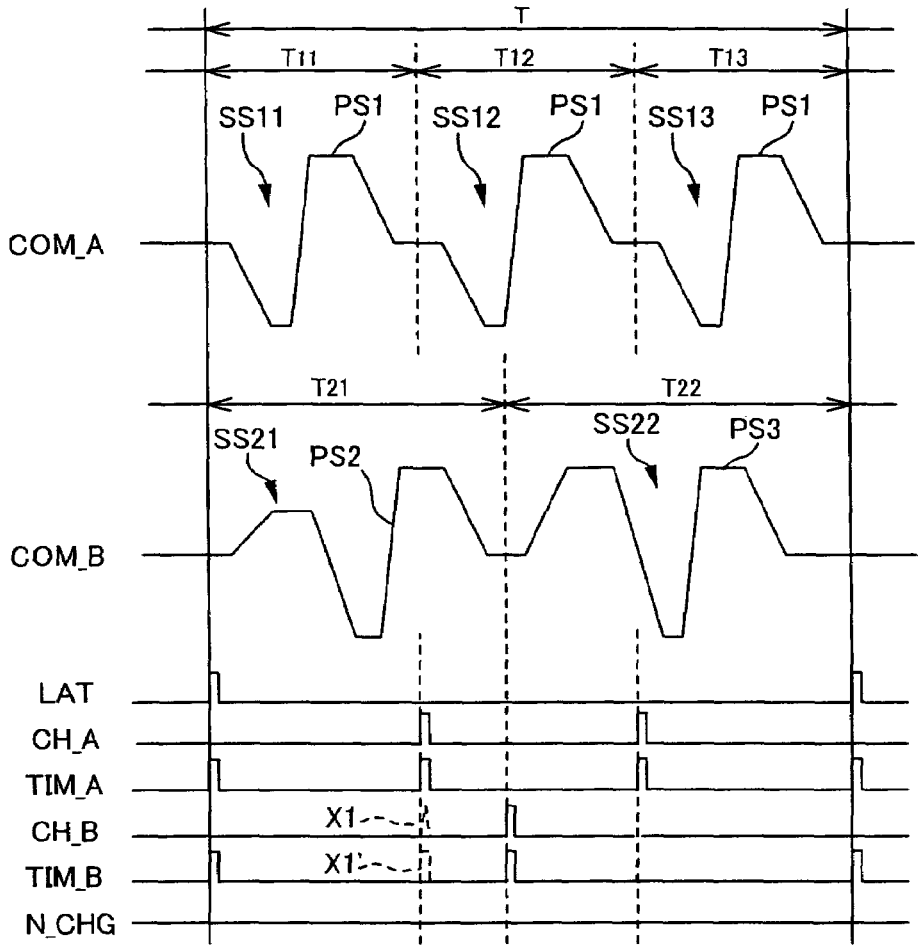
FIG. 12A is a diagram for describing a first drive signal, a second drive signal, and required control signals.
FIG. 12B is a diagram for describing pixel data, a waveform segment selection pattern, and selection data.

Moreover, the decoder 83 also receives a timing signal from the control logic 84. The control logic 84 functions as a timing signal generating section in conjunction with the printer-side controller 60, and generates the timing signal based on the latch signal LAT and the change signals CH_A and CH_B. The timing signal is also generated for each drive signal COM. That is to say, a first timing signal TIM_A for the first drive signal COM_A and a second timing signal TIM_B for the second drive signal COM_B are generated. As shown in FIG. 12A, in the first timing signal TIM_A, timing pulses are generated in synchronization with latch pulses and change pulses for the first drive signal COM_A. Moreover, in the second timing signal TIM_B, timing pulses are generated in synchronization with the latch pulses and change pulses for the second drive signal COM_B.

The selection data that has been generated by the decoder 83 is outputted in order from the high-order bit at the timings defined by the timing signal. That is to say, the first selection data is outputted in synchronization with a rising timing of the first timing signal TIM_A, and the second selection data is outputted in synchronization with a rising timing of the second timing signal TIM_B. Then, the selection data that has been outputted is inputted to the prevention circuit 85.

The prevention circuit 85 is for preventing the first drive signal COM_A and the second drive signal COM_B from being simultaneously applied to one piezo element 417. Thus, the prevention circuit 85 outputs, based on the selection data (switch control signal) that has been inputted thereto, a switch actuating signal SD (see FIG. 14A) for actuating the first switch 87A and the second switch 87B to the first level shifter 86A and the second level shifter 86B. The prevention circuit 85 will be described in greater detail later.

The first level shifter 86A and the second level shifter 86B function as voltage amplifiers. That is to say, when the switch actuating signal SD from the prevention circuit 85 is [1], the first level shifter 86A and the second level shifter 86B output an ON signal whose voltage has been increased to such an extent that a corresponding switch (first switch 87A, second switch 87B) can be driven. For example, when a first switch actuating signal SD_A corresponding to the first selection data is [1], the ON signal whose voltage has been increased to several tens of volts is outputted to the first switch 87A. Similarly, when a second switch actuating signal SD_B corresponding to the second selection data is [1], the ON signal whose voltage has been increased to several tens of volts is outputted to the second switch 87B.

The first drive signal COM_A from the drive signal generating circuit 70 is applied to an input side of the first switch 87A, and the second drive signal COM_B is applied to an input side of the second switch 87B. Moreover, a piezo element 417 is electrically connected to a common output side of the first switch 87A and the second switch 87B. The first switch 87A and the second switch 87B are provided for each of the drive signals COM that are generated. These switches apply the waveform segments SS11 to SS13 constituting the first drive signal COM_A and the waveform segments SS21 and SS22 constituting the second drive signal COM_B to the piezo element 417. Therefore, the first switch 87A and the second switch 87B control application of the corresponding drive signals COM to the piezo element 417.

For example, during a period in which the first switch actuating signal SD_A is [1], the first switch 87A is turned into a connected state by the ON signal, and the first drive signal COM_A is applied to the piezo element 417. Similarly, during a period in which the second switch actuating signal SD_B is [1], the second drive signal COM_B is applied to the piezo element 417. The potential of the piezo element 417 is determined depending on the first drive signal COM_A or the second drive signal COM_B that has been applied thereto. On the other hand, during a period in which both of the first switch actuating signal SD_A and the second switch actuating signal SD_B are [0], the first level shifter 86A and the second level shifter 86B do not output any ON signals for actuating the first switch 87A and the second switch 87B.

In this manner, in the present embodiment, the same number of switches for controlling application of drive signals COM to the piezo element 417 as the number of the drive signals COM are provided. That is to say, a first switch 87A corresponding to the first drive signal COM_A and a second switch 87B corresponding to the second drive signal COM_B are provided. Thus, in order to switch between the drive signals COM to be applied to the piezo element 417, it is only necessary to control the first switch 87A and the second switch 87B individually. Accordingly, switching can be performed in a short period of time, and thus the present printer is suitable for the case where the piezo element 417 is made to operate at a high frequency.

Moreover, the piezo element 417 behaves like a capacitor, and when application of the drive signals COM is stopped, it maintains its potential immediately before the stopping.

Therefore, during the period in which application of the drive signals COM is being stopped, the piezo element 417 maintains its deformed state immediately before the stopping of application of the drive signals COM. The relationship between the selection data and the switch actuating signal SD will be described later.

<Regarding the Printing Operation>

In the printer 1 having the above-described configuration, the printer-side controller 60 controls the sections to be controlled (paper carrying mechanism 20, carriage moving mechanism 30, head unit 40, drive signal generating circuit 70) according to the computer programs stored on the memory 63. Therefore, the computer programs have codes for carrying out the control. By controlling the sections to be controlled, the printing operation with respect to the paper S is performed.

Figure 11:
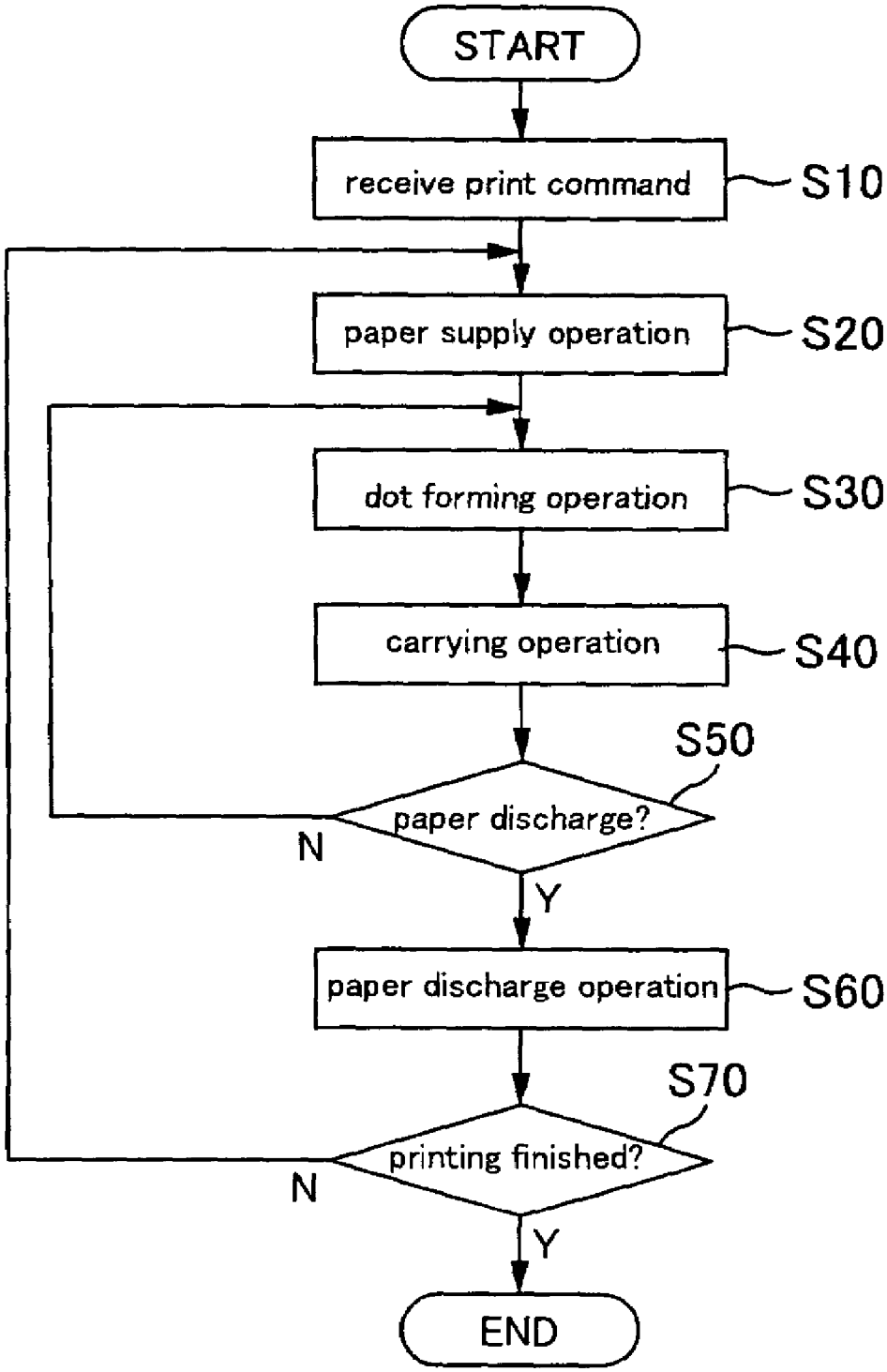
FIG. 11 is a flowchart for describing printing operation.

Here, FIG. 11 is a flowchart for describing the printing operation. The illustrated printing operation includes: print command receiving operation (S10), paper supply operation (S20), dot forming operation (S30), carrying operation (S40), paper discharge determination (S50), paper discharge processing (S60), and print finish determination (S70). Hereinafter, these operations will be described briefly.

The print command receiving operation (S10) is the operation of receiving a print command from the computer 110. In this operation, the printer-side controller 60 receives the print command via the interface section 61.

The paper supply operation (S20) is the operation of moving the paper S to be printed and positioning it in a print start position (so-called "indexed position"). In this operation, the printer-side controller 60 rotates the paper feed roller 21 and the carry roller 23 by, for example, driving the carry motor 22.

The dot forming operation (S30) is the operation for forming dots on the paper S. In this operation, the printer-side controller 60 drives the carriage motor 31 and outputs control signals to the drive signal generating section and the head 41. Thus, ink is ejected from the nozzles Nz while the head 41 is moving, and dots are formed on the paper S.

The carrying operation (S40) is the operation of moving the paper S in the carrying direction. In this operation, the printer-side controller 60 rotates the carry roller 23 by driving the carry motor 22. This carrying operation makes it possible to form dots in positions different from those of the dots that have been formed in the previous dot forming operation.

The paper discharge determination (S50) is the operation of determining whether or not the paper S for which printing is being performed should be discharged. This determination is made by the printer-side controller 60 based on whether or not there still is print data, for example.

The paper discharge processing (S60) is the processing of discharging the paper S, and performed on the condition that it was determined that "the paper S should be discharged" in the previous paper discharge determination. In this case, the printer-side controller 60 discharges, to the outside, the paper S for which printing has finished by rotating the paper discharge roller 25.

The print finish determination (S70) is to determine whether or not printing should be continued. This determination also is made by the printer-side controller 60.

Details of the Prevention Circuit

Next, a configuration and the function of the prevention circuit 85 will be described in greater detail. The prevention circuit 85 in the present embodiment operates during formation of dots (during ejection of ink). Thus, the following discussion on the prevention circuit 85 will be made in light of specific control during ejection of ink.

<Regarding the Drive Signals COM>

FIG. 12A is a diagram for describing the first drive signal COM_A, the second drive signal COM_B, and the required control signals. FIG. 12B is a diagram for describing pixel data (gradation value), a waveform segment selection pattern, and selection data.

The illustrated first drive signal COM_A has the first waveform segment SS11 generated in a period T11, the second waveform segment SS12 generated in a period T12, and the third waveform segment SS13 generated in a period T13. The periods T11, T12, and T13 are of the same duration. The starting timing of the period T12 and the starting timing of the period T13 are synchronized with the rising timing of the first change signal CH_A. All of these first waveform segment SS11, second waveform segment SS12, and third waveform segment SS13 have a first drive pulse PS1. When this first drive pulse PS1 is applied to the piezo element 417, the amount of ink that can form a small dot (small ink droplet) is ejected from the nozzle Nz. It should be noted that, a small dot referred to here has a size suitable for printing of texts. This first drive pulse PS1 corresponds to a unit signal for making the piezo element 417 perform the operation for ejecting ink.

The illustrated second drive signal COM_B has the first waveform segment SS21 generated in a period T21 and the second waveform segment SS22 generated in a period T22. The starting timing of the period T22 is synchronized with the rising timing of the second change signal CH_B. The first waveform segment SS21 has a second drive pulse PS2, and the second waveform segment SS22 has a third drive pulse PS3. When the second drive pulse PS2 is applied to the piezo element 417, the amount of ink that can form a medium dot (medium ink droplet) is ejected from the nozzle Nz. When the third drive pulse PS3 is applied to the piezo element 417, the amount of ink that can form a small dot (small ink droplet) is ejected from the nozzle Nz. It should be noted that a small dot referred to here has a size suitable for printing of images. The second drive pulse PS2 and the third drive pulse PS3 also correspond to the unit signals for making the piezo element 417 perform the operation for ejecting ink.

<Regarding Gradation Control>

Figure 13:
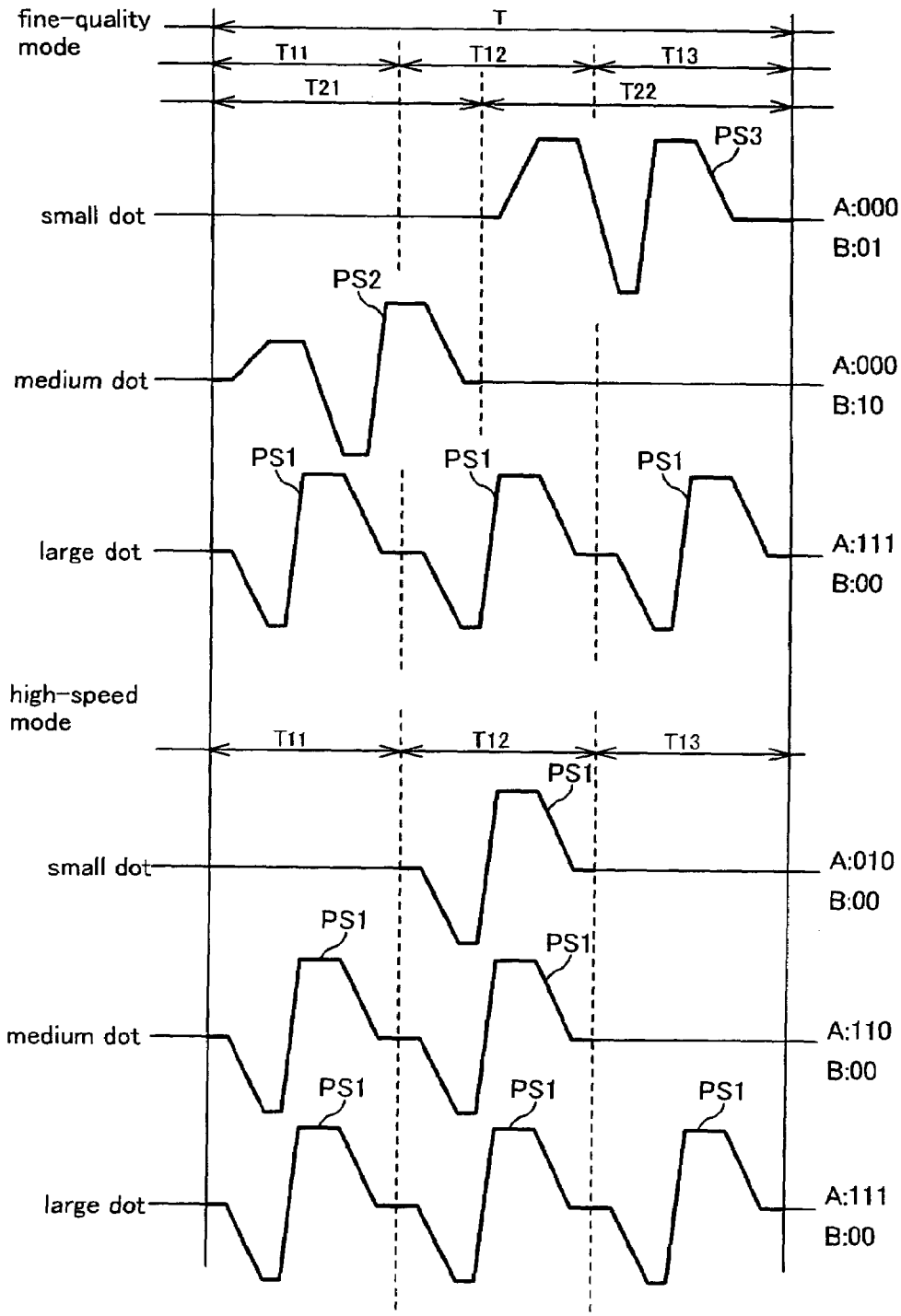
FIG. 13 is a diagram for describing waveform segments applied to a piezo element in formation of a small dot, formation of a medium dot, and formation of a large dot.

Next, gradation control in the printer 1 will be described. Here, FIG. 13 is a diagram for describing the waveform segments applied to the piezo element 417 in formation of a small dot, formation of a medium dot, and formation of a large dot. In this multi-gradation control, the operation of the first switch 87A and the second switch 88B is controlled based on the selection data (switch control signal) generated by the decoder 83.

In the present embodiment, the drive signals COM_A and COM_B are used in common in a plurality of print modes. More specifically, the drive signals are used in common in two modes, i.e., a fine-quality mode suitable for printing of images and a high-speed mode suitable for printing of texts. Therefore, gradation control will be described with respect to each mode. It should be noted that these recording modes are set by the printer driver.

In the present embodiment, when no dots are formed (pixel data [00]), neither the first drive signal COM_A nor the second drive signal COM_B is applied to the piezo element 417. Thus, the discussion on control when no dots are formed is omitted.

<Regarding Gradation Control in the Fine-Quality Mode>

First, gradation control in the fine-quality mode will be described. In this fine-quality mode, when the decoder 83 receives pixel data [01] indicating formation of a small dot, it generates first selection data [000] and second selection data [01]. The first selection data [000] and the second selection data [01] are outputted to the first switch 87A and the second switch 87B in order from a higher-order bit at the timings when the timing signal is turned to the H level, as described above. Here, the second selection data is [01]. Thus, the second drive signal COM_B is applied to the piezo element 417 during the period T22, as shown by a bold line in FIG. 13. That is to say, the second waveform segment SS22 is applied to the piezo element 417. On the other hand, the first selection data is [000]. Thus, the first drive signal COM_A is not applied to the piezo element 417. Consequently, the third drive pulse PS3 is applied to the piezo element 417, and the amount of ink that corresponds to a small dot is ejected from the nozzle Nz.

Next, the case of forming a medium dot (pixel data [10]) will be described. In this case, the decoder 83 generates first selection data [000] and second selection data [10], based on the pixel data [10] indicating formation of a medium dot. Here, since the second selection data is [10], the second drive signal COM_B is applied to the piezo element 417 during the period T21. That is to say, the first waveform segment SS21 is applied to the piezo element 417. On the other hand, since the first selection data is [000], the first drive signal COM_A is not applied to the piezo element 417. Consequently, the second drive pulse PS2 is applied to the piezo element 417, and the amount of ink that corresponds to a medium dot is ejected from the nozzle Nz.

Next, the case of forming a large dot (pixel data [11]) will be described. In this case, the first drive signal COM_A is applied to the piezo element 417. That is to say, the decoder 83 generates first selection data [111] and second selection data [00], based on the pixel data [11] indicating formation of a large dot. Here, since the first selection data is [111], the first drive signal COM_A is applied to the piezo element 417 throughout the periods T11 to T13. Thus, the three waveform segments SS11 to SS13 constituting the first drive signal COM_A are applied to the piezo element 417. On the other hand, since the second selection data is [00], the second drive signal COM_B is not applied to the piezo element 417. From the foregoing, in this case, three first drive pulses PS1 are applied to the piezo element 417, and the amount of ink that corresponds to a large dot is ejected from the nozzle Nz.

<Regarding Gradation Control in the High-Speed Mode>

Next, gradation control in the high-speed mode will be described. In this high-speed mode, gradation control is performed by applying the first drive signal COM_A to the piezo element 417. When the decoder 83 receives pixel data [01] indicating formation of a small dot, it generates first selection data [010] and second selection data [00]. Here, the first selection data is [010]. Thus, the first drive signal COM_A is applied to the piezo element 417 during the period T12. That is to say, the second waveform segment SS12 is applied to the piezo element 417. On the other hand, the second drive signal COM_B is not applied to the piezo element 417. Consequently, one first drive pulse PS1 is applied to the piezo element 417, and the amount of ink that corresponds to a small dot is ejected from the nozzle Nz.

Next, the case of forming a medium dot (pixel data [10]) will be described. In this case, the decoder 83 generates first selection data [110] and second selection data [00], based on the pixel data [10] indicating formation of a medium dot. Here, since the first selection data is [110], the first drive signal COM_A is applied to the piezo element 417 throughout the periods T11 to T12. That is to say, the first waveform segment SS11 and the second waveform segment SS12 are applied to the piezo element 417. On the other hand, the second drive signal COM_B is not applied to the piezo element 417. From the foregoing, in this case, two first drive pulses PS1 are applied to the piezo element 417, and the amount of ink that corresponds to a medium dot is ejected from the nozzle Nz.

It should be noted that, as for the case of forming a large dot (pixel data [11]), the same control as that in the fine-quality mode is performed. Thus, the description thereof is omitted.

The above-mentioned switch controller SWC (first shift register 81A, second shift register 81B, first latching circuit 82A, second latching circuit 82B, decoder 83) outputs the selection data (switch control signal) for each of the drive signals COM, asynchronously. In the present embodiment, since the drive signals COM consist of the first drive signal COM_A and the second drive signal COM_B, the selection data for the first drive signal COM_A and the selection data for the second drive signal COM_B are outputted asynchronously. By employing such a configuration, it is possible to define the duration (period) of the waveform segments in a certain drive signal COM, regardless of the duration (period) of the waveform segments in another drive signal COM. Accordingly, the combination of waveform segments in each drive signal COM can be diversified, and thus various controls can be realized even with a limited cycle period T.

<Regarding the Prevention Circuit 85>

When the above-mentioned control is performed, if the first drive signal COM_A and the second drive signal COM_B are simultaneously applied to the piezo element 417, then the piezo element 417 may perform unexpected operation. For example, if noise occurs in a signal line for the selection data, then the first drive signal COM_A and the second drive signal COM_B may be simultaneously applied. The prevention circuit 85 is for preventing the first drive signal COM_A and the second drive signal COM_B from being simultaneously applied to the piezo element 417. Below, this will be described in greater detail.

Figures 14A, 14B:
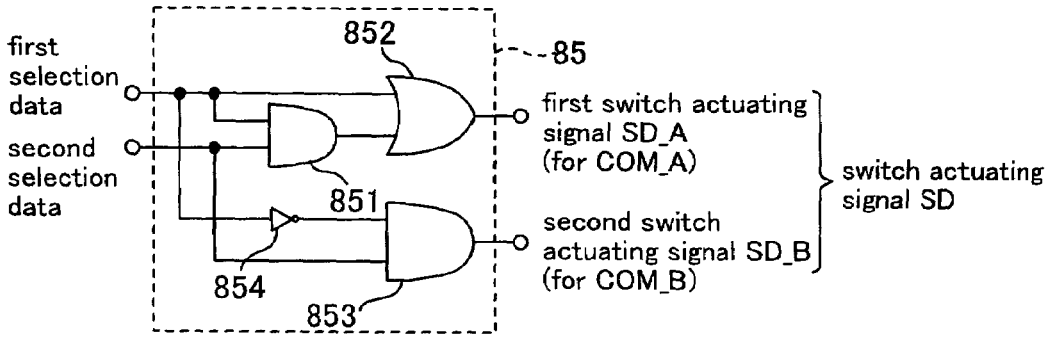
FIG. 14A is a diagram for describing a prevention circuit of a first embodiment.
FIG. 14B is a truth table for describing the function of the prevention circuit.

Here, FIG. 14A is a diagram for describing the prevention circuit 85 in a first embodiment. FIG. 14B is a truth table for describing the function of the prevention circuit 85. This prevention circuit 85 outputs the switch actuating signal SD (first switch actuating signal SD_A, second switch actuating signal SD_B) for actuating the first switch 87A and the second switch 87B, based on the selection signals outputted asynchronously from the switch controller SWC, and is constituted by a logic circuit in the present embodiment. Here, the prevention circuit 85 is constituted by a logic circuit because it becomes possible to perform processing in a short period of time.

The illustrated prevention circuit 85 has two input signal lines and two output signal lines. That is to say, one input signal line is a signal line for inputting the first selection data, and the other input signal line is a signal line for inputting the second selection data. Moreover, one output signal line is for outputting the first switch actuating signal SD_A, and the other output signal line is for outputting the second switch actuating signal SD_B.

The prevention circuit 85 is configured in such a manner that the results in the truth table in FIG. 14B can be obtained. That is to say, when the first selection data indicates that the first switch 87A is to be connected, or when the first selection data indicates that the first switch 87A is to be connected and the second selection data indicates that the second switch 87B is to be connected, the prevention circuit 85 outputs the first switch actuating signal SD_A for connecting the first switch 87A. When only the second selection data indicates that the second switch 87B is to be connected, the prevention circuit 85 outputs the second switch actuating signal SD_B for connecting the second switch 87B.

The prevention circuit 85 in the present embodiment has a first AND circuit 851, an OR circuit 852, a second AND circuit 853, and an inverter 854. The first selection data and the second selection data are inputted to the first AND circuit 851. An output of the first AND circuit 851 is inputted to the OR circuit 852. To the OR circuit 852, the output of the first AND circuit 851 and the first selection data are inputted. Then, an output of the OR circuit 852 serves as the first switch actuating signal SD_A. To the second AND circuit 853, an inverse signal of the first selection data that has been inverted by the inverter 854 and the second selection data are inputted. Then, an output of the second AND circuit 853 serves as the second switch actuating signal SD_B.

The prevention circuit 85 with such a configuration outputs the first switch actuating signal SD_A so that the first drive signal COM_A is applied to the piezo element 417, even when the selection data (switch control signal) indicates that the first drive signal COM_A and the second drive signal COM_B are to be simultaneously applied to the piezo element 417. By employing such a configuration, even when such selection data that causes a plurality of drive signals COM to be simultaneously applied is outputted, only one drive signal COM that has been selected will be applied to the piezo element 417. For example, assume a case in which noise X1 occurs in a signal line for the second change signal CH_B at the boundary timing between the period T11 and the period T12, as shown by a dotted line in FIG. 12A. In this case, based on the noise X1, the control logic 84 will generate a timing pulse X1' in the second timing signal TIM_B. Then, the timing pulse generated in the first timing signal TIM_A and the timing pulse X1' will be inputted to the prevention circuit 85 at the same timing. Even in such a case, the prevention circuit 85 outputs the switch actuating signal SD so that only one of the drive signals COM, i.e., the first drive signal COM_A, is applied to the piezo element 417. Accordingly, a failure in which the piezo element 417 performs unexpected operation can be prevented effectively.

Second Embodiment

The above-described prevention circuit 85 in the first embodiment outputted the switch actuating signal SD (first switch actuating signal SD_A, second switch actuating signal SD_B), based on the first selection data corresponding to the first drive signal COM_A and the second selection data corresponding to the second drive signal COM_B. However, signals inputted to the prevention circuit 85 are not limited to the selection data. For example, it is also possible to configure the prevention circuit such that, when the all-ON signal (forced application signal) for applying the drive signals COM to the piezo element 417 regardless of the selection data (switch control signal) is inputted, the prevention circuit outputs the switch actuating signal SD for actuating the first switch 87A and the second switch 87B so that one drive signal COM that has been selected is applied to the piezo element 417.

Figures 15A, 15B:
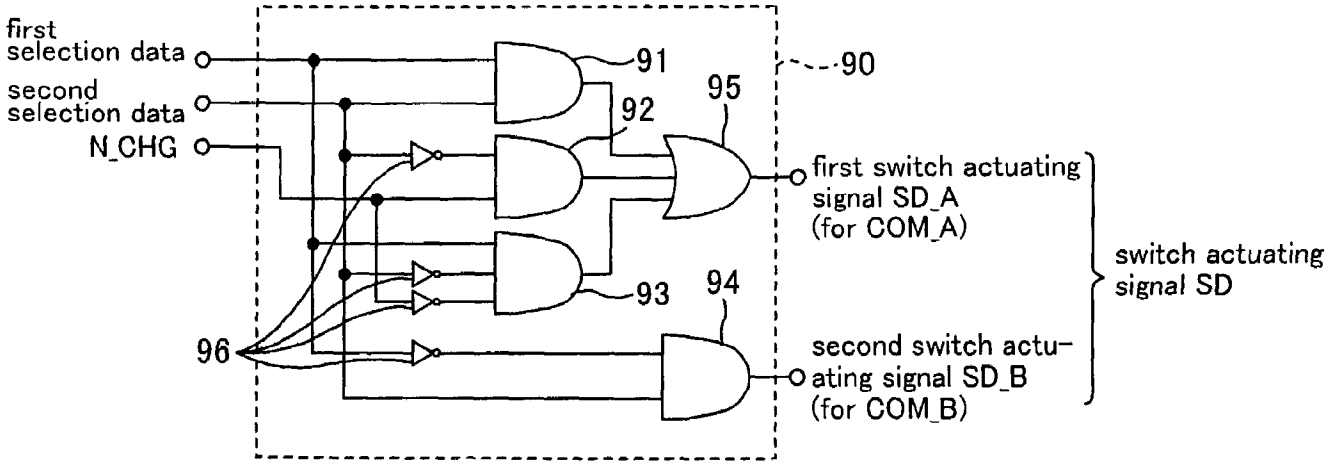
FIG. 15A is a diagram for describing a prevention circuit of a second embodiment.
FIG. 15B is a truth table for describing the function of the prevention circuit.

Hereinafter, a second embodiment having such a configuration will be described. Here, FIG. 15A is a diagram for describing a prevention circuit 90 in the second embodiment. FIG. 15B is a truth table for describing the function of the prevention circuit 90.

The prevention circuit 90 in the second embodiment replaces the prevention circuit 85 in the first embodiment. The illustrated prevention circuit 90 has three input signal lines and two output signal lines. That is to say, one input signal line is the signal line for inputting the first selection data, and another input signal line is the signal line for inputting the second selection data. Furthermore, the other input signal line is a signal line for inputting the all-ON signal N_CHG. One output signal line is for outputting the first switch actuating signal SD_A and the other output signal line is for outputting the second switch actuating signal SD_B.

The prevention circuit 90 is configured in such a manner that the results in the truth table in FIG. 15B can be obtained. That is to say, when the first selection data indicates that the first switch 87A is to be connected, the prevention circuit 90 outputs the first switch actuating signal SD_A for connecting the first switch 87A, regardless of the content of the second selection data and the all-ON signal N_CHG. Also when only the all-ON signal is received, the prevention circuit 90 outputs the first switch actuating signal SD_A for connecting the first switch 87A. Moreover, when the second selection data indicates that the second switch 87B is to be connected and the first selection data indicates that the first switch 87A is not to be connected, the prevention circuit 90 outputs the second switch actuating signal SD_B for connecting the second switch 87B, regardless of the content of the all-ON signal N_CHG. It should be noted that if the first selection data indicates that the first switch 87A is not to be connected, the second selection data indicates that the second switch 87B is not to be connected, and also the all-ON signal N_CHG is not received, then neither the first switch actuating signal SD_A nor the second switch actuating signal SD_B is outputted.

The prevention circuit 90 in the present embodiment has a first AND circuit 91, a second AND circuit 92, a third AND circuit 93, a fourth AND circuit 94, an OR circuit 95, and a plurality of inverters 96. The first selection data and the second selection data are inputted to the first AND circuit 91. The output of the first AND circuit 91 is inputted to the OR circuit 95. To the second AND circuit 92, inverse data of the second selection data that has been inverted by the inverter 96 and the all-ON signal N_CHG are inputted. The output of the second AND circuit 92 also is inputted to the OR circuit 95. To the third AND circuit 93, the first selection data, inverse data of the second selection data that has been inverted by the inverter 96, and an inverse signal of the all-ON signal N_CHG that has been inverted by the inverter 96 are inputted. Then, the output of the third AND circuit 93 also is inputted to the OR circuit 95. The output of the OR circuit 95 serves as the first switch actuating signal SD_A. Moreover, to the fourth AND circuit 94, an inverse signal of the first selection data that has been inverted by the inverter 96 and the second selection data are inputted. The output of the fourth AND circuit 94 serves as the second switch actuating signal SD_B.

Moreover, in this prevention circuit 90, when the selection data (first selection data, second selection data) indicates, at the timing when the all-ON signal N_CHG is inputted, that one drive signal COM is to be applied to the piezo element 417, the switch actuating signal SD (first switch actuating signal SD_A, second switch actuating signal SD_B) is outputted so that the drive signal COM indicated by that selection data is applied to the piezo element 417. More specifically, when the first selection data indicates, at the timing when the all-ON signal N_CHG is inputted, that the first drive signal COM_A is to be applied, the prevention circuit 90 outputs the first switch actuating signal SD_A. Moreover, when the second selection data indicates, at the timing when the all-ON signal N_CHG is inputted, that the second drive signal COM_B is to be applied, the prevention circuit 90 outputs the second switch actuating signal SD_B.

In addition, in this prevention circuit 90, when the selection data indicates, at the timing when the all-ON signal N_CHG is inputted, that a plurality of drive signals are to be applied to the piezo element 417, the switch actuating signal SD is outputted so that a particular drive signal SD is applied to the piezo element 417. More specifically, when the selection data indicates, at the timing when the all-ON signal N_CHG is inputted, that the first drive signal COM_A and the second drive signal COM_B are to be applied to the piezo element 417, the switch actuating signal SD is outputted so that the first drive signal COM_A is applied to the piezo element 417.

With such a configuration, the prevention circuit 90 of the present embodiment can reliably prevent a failure in which a plurality of drive signals COM is simultaneously applied to the piezo element 417, even when the drive signals COM are forcibly applied by the all-ON signal N_CHG.

Other Embodiments

In the foregoing embodiments, a printing system 100 having a printer 1 was mainly discussed. However, the foregoing description also includes the disclosure of print control apparatuses and the print control methods, for example. Moreover, the foregoing embodiments are for the purpose of elucidating the present invention and are not to be interpreted as limiting the present invention. It goes without saying that the present invention can be altered and improved without departing from the gist thereof and includes functional equivalents. In particular, the present invention also includes embodiments described below.

<Regarding the Selection Data>

Figures 16A, 16B:
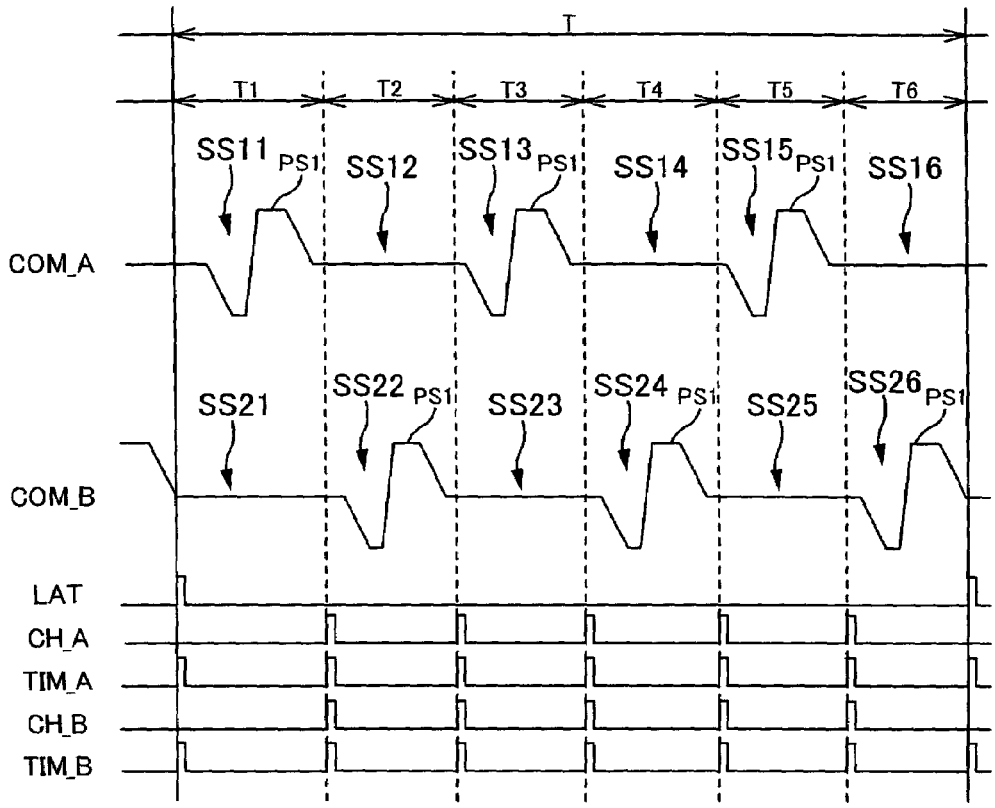
FIG. 16A shows an example of a configuration in which a plurality of sets of selection data are outputted synchronously.
FIG. 16B is a diagram for describing pixel data, a waveform segment selection pattern, and selection data.

In the above-described embodiments, the selection data for the first drive signal COM_A and the selection data for the second drive signal COM_B were outputted asynchronously with each other. Regarding the selection data, a plurality of sets of selection data may be outputted synchronously. Here, FIG. 16A shows an example of a configuration in which a plurality of sets of selection data is outputted synchronously. FIG. 16B is a diagram for describing pixel data (gradation value), a waveform segment selection pattern, and selection data. In this example, a cycle period T consists of periods T1 to T6, and the selection data is outputted at the boundary timings between adjacent periods.

The illustrated first drive signal COM_A has a first waveform segment SS11 generated in the period T1, a second waveform segment SS12 generated in the period T2, a third waveform segment SS13 generated in the period T3, a fourth waveform segment SS14 generated in the period T4, a fifth waveform segment SS15 generated in the period T5, and a sixth waveform segment SS16 generated in the period T6. Among these waveform segments, the first waveform segment SS11, the third waveform segment SS13, and the fifth waveform segment SS15 have a first drive pulse PS1. This first drive pulse PS1 has the same waveform as the first drive pulse PS1 shown in FIG. 12A. Moreover, the second waveform segment SS12, the fourth waveform segment SS14, and the sixth waveform segment SS16 are kept constant at an intermediate potential Vc.

The illustrated second drive signal COM_B has a first waveform segment SS21 generated in the period T1, a second waveform segment SS22 generated in the period T2, a third waveform segment SS23 generated in the period T3, a fourth waveform segment SS24 generated in the period T4, a fifth waveform segment SS25 generated in the period T5, and a sixth waveform segment SS26 generated in the period T6. In the present embodiment, the durations of the first to sixth waveform segments SS21 to SS26 of the second drive signal COM_B are set to the same durations as the corresponding first to sixth waveform segments SS11 to SS16 of the first drive signal COM_A. Accordingly, the first change signal CH_A for the first drive signal COM_A and the second change signal CH_B for the second drive signal COM_B are turned to the H level at the same timing. In other words, pulses are generated synchronously. In the second drive signal COM_B, the first waveform segment SS21, the third waveform segment SS23, and the fifth waveform segment SS25 are constant-potential signals that are kept constant at the intermediate potential Vc. Moreover, the second waveform segment SS22, the fourth waveform segment SS24, and the sixth waveform segment SS26 have the first drive pulse PS1.

Next, gradation control in this printer 1 will be described. First, when no dots are formed (pixel data [00]), the decoder 83 generates first selection data [000000] and second selection data [000000], based on the pixel data [00] indicating no recording. Thus, the waveform segments SS11 to SS16 of the first drive signal COM_A and the waveform segments SS21 to SS26 of the second drive signal COM_B are not applied to the piezo element 417.

In the case of forming a small dot (pixel data [01]), the decoder 83 generates first selection data [001000] and second selection data [000000], based on the pixel data [01] indicating formation of a small dot. Thus, the first drive pulse PS1 generated in the period T3 is applied to the piezo element 417, and the amount of ink that corresponds to a small dot is ejected from the nozzle Nz.

In the case of forming a medium dot (pixel data [10]), the decoder 83 generates first selection data [001000] and second selection data [010100], based on the pixel data [10] indicating formation of a medium dot. Thus, the first drive pulses PS1 generated in the respective periods T2, T3, and T4 are applied to the piezo element 417, and the amount of ink that corresponds to a medium dot is ejected from the nozzle Nz.

Next, in the case of forming a large dot (pixel data [11]), the decoder 83 generates first selection data [101010] and second selection data [010101], based on the pixel data [11] indicating formation of a large dot. Thus, the three first drive pulses PS1 of the first drive signal COM_A and the three first drive pulses PS1 of the second drive signal COM_B are applied to the piezo element 417, and the amount of ink that corresponds to a large dot is ejected from the nozzle Nz. Consequently, a large dot is formed on the paper S.

In this manner, by outputting a plurality of sets of selection data synchronously, timing control is facilitated, and thus it is possible to simplify control. Even in such a configuration, the above-described prevention circuits 85 and 90 can reliably prevent a failure in which a plurality of drive signals COM are simultaneously applied to the piezo element 417.

<Regarding the Printing System>

Regarding the printing system, the foregoing embodiments described a printing system 100 in which a printer 1 serving as a printing apparatus and a computer 110 serving as a print control apparatus were configured separately. However, the present invention is not limited to this configuration. A printing system in which the printing apparatus and the print control apparatus are integrated is also possible.

<Regarding the Driving Element>

In the foregoing embodiments, ink ejection was performed using the piezo element 417. However, the element for ejecting ink is not limited to the piezo element 417. For example, an element such as a heater element or a magnetostrictive element can be used, as long as it can perform the operation for ejecting ink.

<Regarding the Ink>

Since the above-described embodiments were discussed using the printer 1, a dye ink or a pigment ink was ejected from the nozzles Nz. However, the ink that is ejected from the nozzles Nz is not limited to such inks. Moreover, also the color of the ink is not limited to the above-mentioned four colors.

<Regarding Other Applications>

Moreover, a printer 1 was discussed in the above-described embodiments. However, this is not a limitation. For example, technology like that of the present embodiments can also be adopted for various types of recording apparatuses that use inkjet technology, such as color filter manufacturing apparatuses, dyeing apparatuses, fine processing apparatuses, semiconductor manufacturing apparatuses, surface processing apparatuses, three-dimensional shape forming apparatuses, liquid vaporizing apparatuses, organic EL manufacturing apparatuses (in particular, macromolecular EL manufacturing apparatuses), display manufacturing apparatuses, film formation apparatuses, and DNA chip manufacturing apparatuses. Moreover, methods therefor and manufacturing methods thereof are also within the scope of application.

What is claimed is:

1. A printing apparatus comprising, a drive signal generating circuit that can generate a plurality of drive signals, an element to which said plurality of drive signals can be applied and that performs operation for electing ink according to the applied drive signals, a prevention circuit for preventing said plurality of drive signals from being simultaneously applied to said element, a plurality of switches that are provided in one-to-one correspondence with said plurality of drive signals, each of said switch controlling application of the corresponding drive signal to said element, and a switch controller that outputs, to said prevention circuit, a switch control signal for controlling actuation of said plurality of switches, wherein said prevention circuit outputs, based on said switch control signal inputted thereto, a switch actuating signal for actuating said switches to each of said plurality of switches.

2. A printing apparatus according to claim 1, wherein when said switch control signal inputted to said prevention circuit is for simultaneously applying said plurality of drive signals to said element, said prevention circuit outputs the switch actuating signal for actuating said switches so that a selected one of said drive signals is applied to said element.

3. A printing apparatus according to claim 1, wherein when a forced application signal for applying said drive signals to said element regardless of said switch control signal is inputted to said prevention circuit, said prevention circuit outputs the switch actuating signal for actuating said switches so that a selected one of said drive signals is applied to said element.

4. A printing apparatus according to claim 3, wherein when said switch control signal indicates, at the timing when said forced application signal is inputted to said prevention circuit, that one of said drive signals is to be applied to said element, said prevention circuit outputs the switch actuating signal for actuating said switches so that the drive signal indicated by that switch control signal is applied to said element.

5. A printing apparatus according to claim 3, wherein when said switch control signal indicates, at the timing when said forced application signal is inputted to said prevention circuit, that a plurality of said drive signals are to be applied to said element, said prevention circuit outputs the switch actuating signal for actuating said switches so that a particular one of said drive signals is applied to said element.

6. A printing apparatus according to claim 1, wherein said switch controller outputs said switch control signal based on gradation data indicating a gradation level of a dot to be formed by the ejected ink.

7. A printing apparatus according to claim 1, wherein said switch controller outputs said switch control signal for each of said plurality of drive signals.

8. A printing apparatus according to claim 7, wherein said switch controller outputs at least two said switch control signals asynchronously with each other.

9. A printing apparatus according to claim 7, wherein said switch controller outputs all of the plurality of said switch control signals synchronously.

10. A printing apparatus according to claim 1, wherein said prevention circuit is constituted by a logic circuit.

11. A printing apparatus according to claim 1, wherein said element is a piezo element.

12. A printing apparatus comprising:

a drive signal generating circuit that can generate a plurality of drive signals, an element to which said plurality of drive signals can be applied and that performs operation for ejecting ink according to the applied drive signals, a prevention circuit for preventing said plurality of drive signals from being simultaneously applied to said element, a plurality of switches that are provided in one-to-one correspondence with said plurality of drive signals, each of said switch controlling application of the corresponding drive signal to said element, and a switch controller that outputs, to said prevention circuit, a switch control signal for controlling actuation of said plurality of switches;

wherein said element is a piezo element;

wherein said prevention circuit is constituted by a logic circuit, and outputs, based on said switch control signal inputted thereto, a switch actuating signal for actuating said switches to each of said plurality of switches;

wherein when said switch control signal inputted to said prevention circuit is for simultaneously applying said plurality of drive signals to said element, said prevention circuit outputs, to each of said plurality of switches, the switch actuating signal for actuating said switches so that a selected one of said drive signals is applied to said element;

wherein when a forced application signal for applying said drive signals to said element regardless of said switch control signal is inputted to said prevention circuit, said prevention circuit outputs the switch actuating signal for actuating said switches so that a selected one of said drive signals is applied to said element;

wherein when said switch control signal indicates, at the timing when said forced application signal is inputted to said prevention circuit, that one of said drive signals is to be applied to said element, said prevention circuit outputs the switch actuating signal for actuating said switches so that the drive signal indicated by that switch control signal is applied to said element;

wherein when said switch control signal indicates, at the timing when said forced application signal is inputted to said prevention circuit, that a plurality of said drive signals are to be applied to said element, said prevention circuit outputs the switch actuating signal for actuating said switches so that a particular one of said drive signals is applied to said element;

wherein said switch controller outputs said switch control signal based on gradation data indicating a gradation level of a dot to be formed by the ejected ink;

wherein said switch controller outputs said switch control signal for each of said plurality of drive signals; and wherein said switch controller outputs at least two said switch control signals asynchronously with each other, or all of the plurality of said switch control signals synchronously.

13. A printing system comprising:

a printing apparatus that comprises:

a drive signal generating circuit that can generate a plurality of drive signals, an element to which said plurality of drive signals can be applied and that performs operation for ejecting ink according to the applied drive signals, a prevention circuit for preventing said plurality of drive signals from being simultaneously applied to said element, a plurality of switches that are provided in one-to-one correspondence with said plurality of drive signals, each of said switch controlling application of the corresponding drive signal to said element, and a switch controller that outputs, to said prevention circuit, a switch control signal for controlling actuation of said plurality of switches, wherein said prevention circuit outputs, based on said switch control signal inputted thereto, a switch actuating signal for actuating said switches to each of said plurality of switches; and a print control apparatus that controls operations of said printing apparatus.

* * * * *